US007896565B2

(12) United States Patent
Igarashi et al.

(10) Patent No.: US 7,896,565 B2
(45) Date of Patent: Mar. 1, 2011

(54) PRINTING APPARATUS, METHOD FOR COPING WITH STICK-SLIP, PROGRAM PRODUCT, AND PRINTING SYSTEM

(75) Inventors: Hitoshi Igarashi, Shiojiri (JP); Kaoru Koyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 950 days.

(21) Appl. No.: 11/728,479

(22) Filed: Mar. 26, 2007

(65) Prior Publication Data

US 2007/0223983 A1 Sep. 27, 2007

(30) Foreign Application Priority Data

Mar. 24, 2006 (JP) ..... 2006-083441

(51) Int. Cl.
*B41J 19/30* (2006.01)

(52) U.S. Cl. ..... 400/323; 400/320.1; 400/322

(58) Field of Classification Search ..... 400/320, 400/320.1, 322, 323, 335, 337, 338, 354
See application file for complete search history.

(56) References Cited

U.S. PATENT DOCUMENTS 6,528,962 B1 * 3/2003 Igarashi et al. ..... 318/461
2004/0197126 A1 * 10/2004 Igarashi ..... 400/582

FOREIGN PATENT DOCUMENTS

JP 2000-043359 A 2/2000
JP 2000-301228 A 10/2000
JP 2001-103778 4/2001
JP 2001-158144 6/2001
JP 2001-169584 6/2001
JP 2001-171858 A 6/2001
JP 2005-186630 7/2005
JP 2006-281553 10/2006
JP 2006-281554 10/2006
JP 2006-312285 11/2006
JP 2006-312286 11/2006

* cited by examiner

*Primary Examiner*—Ren Yan
(74) *Attorney, Agent, or Firm*—Nutter McClennen & Fish LLP; John J. Penny, Jr.

(57) ABSTRACT

A print head is operable to perform printing with respect to a medium. A motor is operable to move the print head. A guide unit is operable to guide the print head along a predetermined direction. A determination unit is operable to determine whether or not the print head performs a stick-slip operation. A motor control unit is operable to generate a command value for controlling the motor when moving the print head. The motor control unit generates a command value for moving the print head at a predetermined target speed on the basis of determination of the determination unit that the print head does not perform the stick-slip operation and generates a command value for moving the print head at a target speed faster than the predetermined target speed on the basis of determination of the determination unit that the print head performs the stick-slip operation.

14 Claims, 24 Drawing Sheets

MOVEMENT SPEED OF CARRIAGE AND DUTY SIGNAL VALUE AT THE TIME OF STICK-SLIP OPERATION

| | REGION A | REGION B | REGION C | REGION D | REGION E | REGION F | REGION G | REGION H |
|---|---|---|---|---|---|---|---|---|
| STICK-SLIP REGION BYTE DATA FOR FORWARD MOVEMENT | 1 | 0 | 0 | 0 | 0 | 0 | 0 | 0 |
| STICK-SLIP REGION BYTE DATA FOR BACKWARD MOVEMENT | 0 | 0 | 1 | 0 | 0 | 0 | 0 | 0 |

FIG. 21A

| STARTING POINT COUNT VALUE | ENDING POINT COUNT VALUE |
|---|---|
| 200 | 400 |
| | |

FIG. 21B

| STARTING POINT COUNT VALUE | ENDING POINT COUNT VALUE |
|---|---|
| 200 | 400 |
| 1600 | 1800 |
| 1700 | 1900 |
| | |

⇨

| STARTING POINT COUNT VALUE | ENDING POINT COUNT VALUE |
|---|---|
| 200 | 400 |
| 1600 | 1900 |
| | |

FIG. 22A

| STARTING POINT COUNT VALUE | ENDING POINT COUNT VALUE |
|---|---|
| 200 | 400 |
| 1600 | 1900 |
| 5600 | 5800 |
| | |

⇨

FIG. 22B

| STARTING POINT COUNT VALUE | ENDING POINT COUNT VALUE |
|---|---|
| 100 | 500 |
| 1700 | 2000 |
| 5500 | 6000 |
| | |

PRINTING APPARATUS, METHOD FOR COPING WITH STICK-SLIP, PROGRAM PRODUCT, AND PRINTING SYSTEM

The disclosure of Japanese Patent Application No. 2006-083441 filed Mar. 24, 2006 including specification, drawings and claims is incorporated herein by reference in its entirety.

BACKGROUND

The present invention relates to a printing apparatus, a method for coping with stick-slip, a program product, and a printing system.

As a printing apparatus that performs printing with respect to a medium such as paper and a film, for example, an inkjet printer is known. The inkjet printer includes a print head that ejects ink onto a medium. The print head ejects ink while moving relatively with respect to the medium, such that printing with respect to the medium is performed.

The print head moves while being guided along a predetermined direction by a guide unit provided inside the printer. The print head is moved by a motor. The print head accelerates up to a predetermined speed by a control unit of the motor and then moves at the predetermined constant speed by PID control, for example, thereby moving up to a target position (refer to Japanese Patent Publication No. 2001-103778 A, Japanese Patent Publication No. 2001-158144 A, and Japanese Patent Publication No. 2001-169584 A).

In the inkjet printer, the following problems have occurred. For example, when an inkjet printer has not been used for a long period of time, a print head does not move smoothly along a guide unit but repeats an operation of moving and stopping. That is, the print head performs a stick-slip operation. The stick-slip operation occurs due to solidification of grease at a sliding part located between the print head and the guide unit, for example. Especially in a case in which the print head moves at a low speed, such stick-slip operation occurs.

When the stick-slip operation occurs, it takes time to cause the print head to move and then stop at a target position within a predetermined range.

Therefore, it is necessary to cope with such phenomenon.

SUMMARY

It is therefore an object of the invention to quickly cope with a case in which a print head performs a stick-slip operation.

In order to achieve the above-mentioned object, according to an aspect of the invention, there is provided a printing apparatus comprising:

a print head operable to perform printing with respect to a medium;

a motor operable to move the print head;

a guide unit operable to guide the print head along a predetermined direction;

a determination unit operable to determine whether or not the print head performs a stick-slip operation; and a motor control unit operable to generate a command value for controlling the motor when moving the print head, wherein the motor control unit generates a command value for moving the print head at a predetermined target speed on the basis of determination of the determination unit that the print head does not perform the stick-slip operation and generates a command value for moving the print head at a target speed faster than the predetermined target speed on the basis of determination of the determination unit that the print head performs the stick-slip operation.

With this configuration, on the basis of the determination that the stick-slip operation is performed, the movement of the print head is controlled by raising the target speed so that the stick-slip operation does not easily occur. As a result, it is possible to suppress the stick-slip operation from occurring.

The target speed faster than the predetermined target speed may be set on the basis of a distance from the print head to a target stopping position of the print head.

The target speed faster than the predetermined target speed may be set to a fixed value when the distance from the print head to the target stopping position of the print head is larger than a predetermined distance.

The target speed faster than the predetermined target speed may be set to a speed higher than a maximum speed of the print head at the time of the stick-slip operation when the distance from the print head to the target stopping position of the print head is larger than a predetermined distance.

The printing apparatus may further comprise:

a storage unit operable to store a stick-slip region set on the basis of a position determined by the determination unit, in which the print head performs the stick-slip operation, wherein the motor control unit generates a command value for moving the print head at the predetermined target speed when the print head is not positioned in the stick-slip region and generates a command value for moving the print head at the target speed faster than the predetermined target speed when the print head is positioned in the stick-slip region.

The storage unit may store a predetermined range from the position determined by the determination unit, in which the print head performs the stick-slip operation, as the stick-slip region.

The determination on whether the stick-slip operation is performed or not may be made by the determination unit when the print head moves along the guide unit at a speed equal to or lower than a predetermined speed.

The printing apparatus may farther comprise:

a speed detection unit operable to detect a movement speed of the print head, wherein the determination unit determines whether or not the print head performs a stick-slip operation on the basis of the movement speed detected by the speed detection unit.

The determination unit may determine whether or not the print head performs a stick-slip operation on the basis of the command value.

The printing apparatus may further comprise:

an acceleration detection unit operable to detect acceleration of the print head, wherein the determination unit determines whether or not the print head performs a stick-slip operation on the basis of the acceleration detected by the acceleration detection unit.

The printing apparatus may further comprise:

a timer that measures time, for which a movement speed of the print head is equal to or lower than a predetermined allowed lower-limit value, over a period of time from starting of movement of the print head to completion of the movement of the print head, wherein the determination unit determines whether or not the print head performs a stick-slip operation on the basis of the time measured by the timer.

The print head may have nozzles from which ink is ejected toward the medium in order to perform printing with respect to the medium.

According to an aspect of the invention, there is also provided a method for coping with stick-slip comprising:

generating a command value for controlling a motor operable to move a print head in order to move the print head, which performs printing with respect to a medium, along a guide unit that guides the print head along a predetermined direction;

determining whether or not the print head performs a stick-slip operation; and generating a command value for moving the print head at a predetermined target speed on the basis of the determination that the print head does not perform the stick-slip operation and generating a command value for moving the print head at a target speed faster than the predetermined target speed on the basis of the determination that the print head performs the stick-slip operation.

With this configuration, on the basis of the determination that the stick-slip operation is performed, the movement of the print head is controlled by raising the target speed so that the stick-slip operation does not easily occur. As a result, it is possible to suppress the stick-slip operation from occurring.

According to an aspect of the invention, there is also provided a program product comprising a recording medium having recorded a program operable to cause a computer to execute the above described method.

BRIEF DESCRIPTION OF THE DRAWINGS

The above objects and advantages of the present invention will become more apparent by describing in detail preferred exemplary embodiments thereof with reference to the accompanying drawings, wherein:

FIG. 21A is a view illustrating starting point count value and ending point count value of a stick-slip region stored in a main memory 127;

FIG. 21B is a view illustrating an example of processing when stick-slip regions overlap;

FIG. 22A is a view illustrating starting point count value and ending point count value of a stick-slip region in the forward direction;

FIG. 22B is a view illustrating starting point count value and ending point count value of a stick-slip region in the backward direction;

DETAILED DESCRIPTION OF THE EMBODIMENTS

Summary of Printing Apparatus

Figure 1:
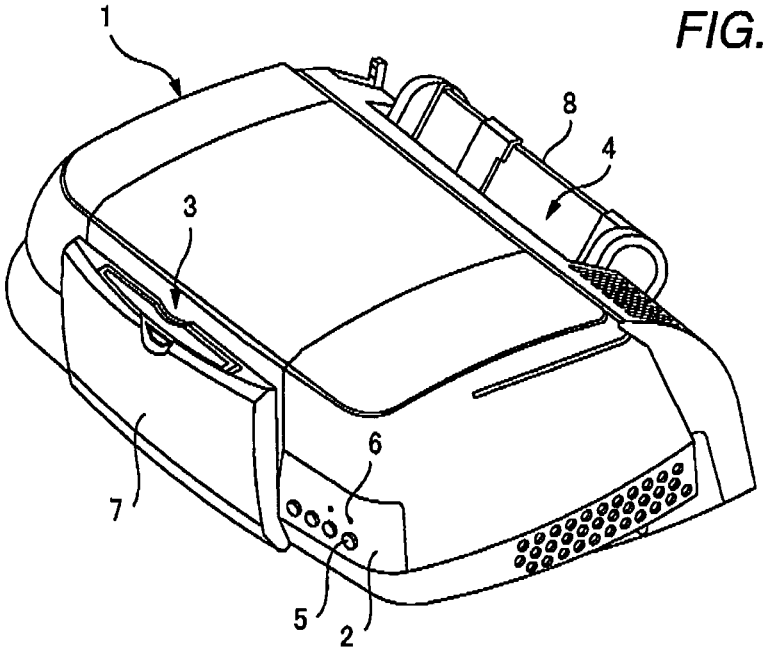
FIG. 1 is a perspective view illustrating a printing apparatus according to an embodiment of the invention.
Figure 2:
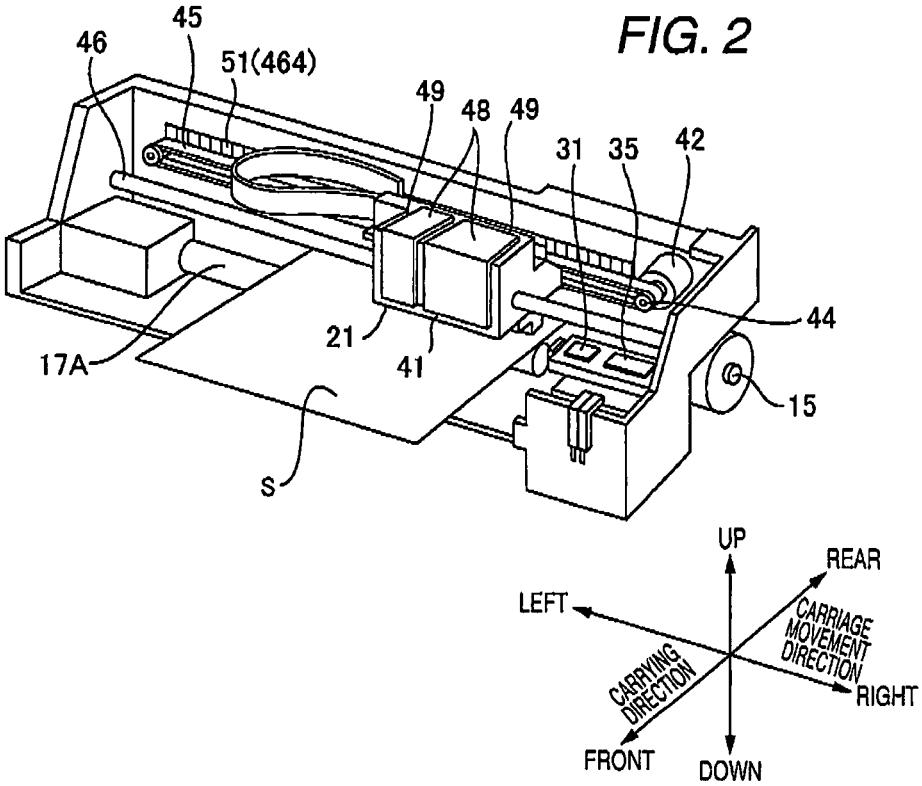
FIG. 2 is a perspective view illustrating the internal configuration of the printing apparatus.

A printing apparatus according to an embodiment of the invention will now be described by using an inkjet printer 1 as an example. FIGS. 1 to 4 illustrate the inkjet printer 1. FIG. 1 illustrates outer appearance of the inkjet printer 1. FIG. 2 illustrates the internal configuration of the inkjet printer 1.

Figure 3:
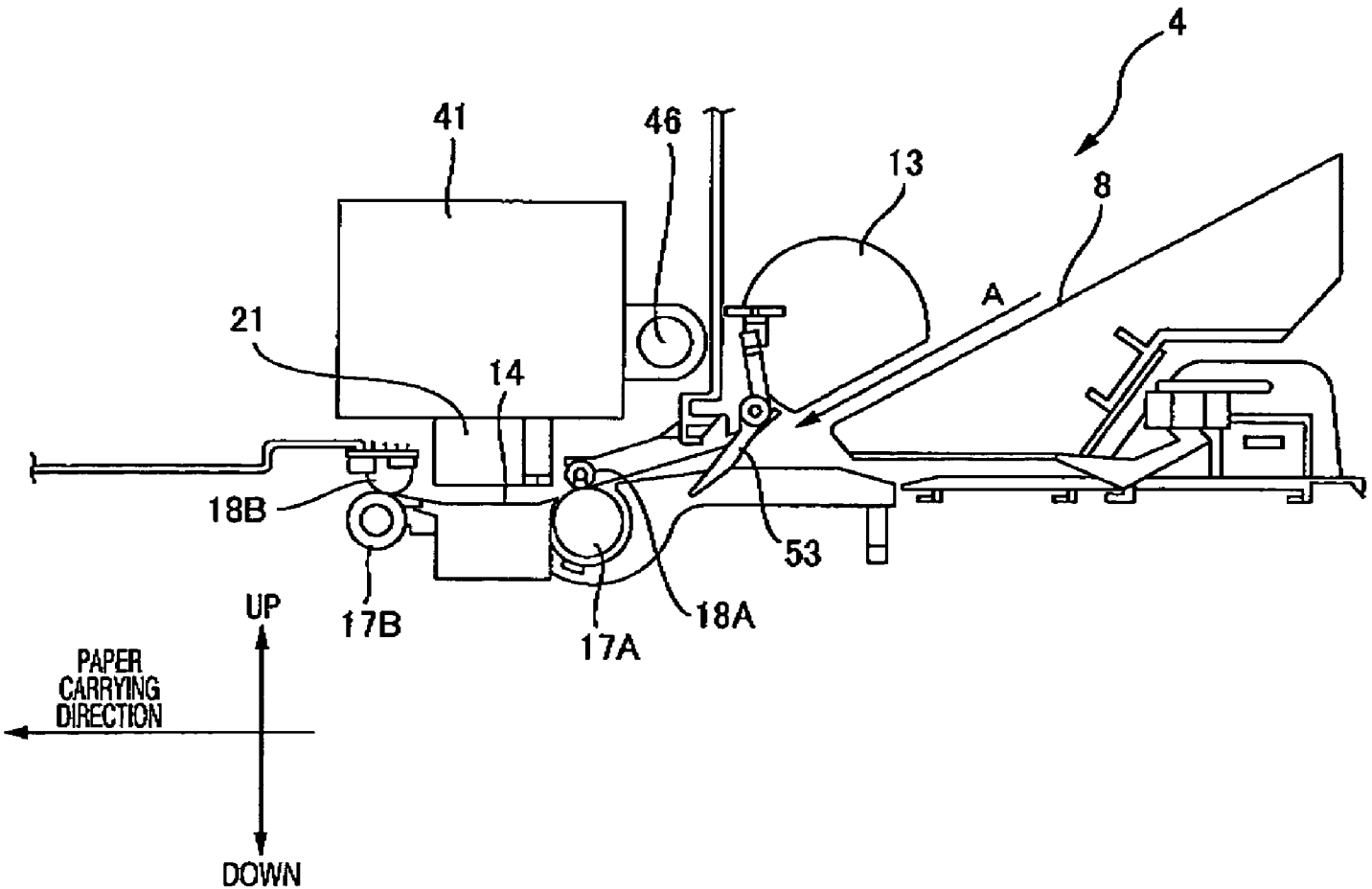
FIG. 3 is a cross-sectional view illustrating a carrying unit of the printing apparatus.
Figure 4:
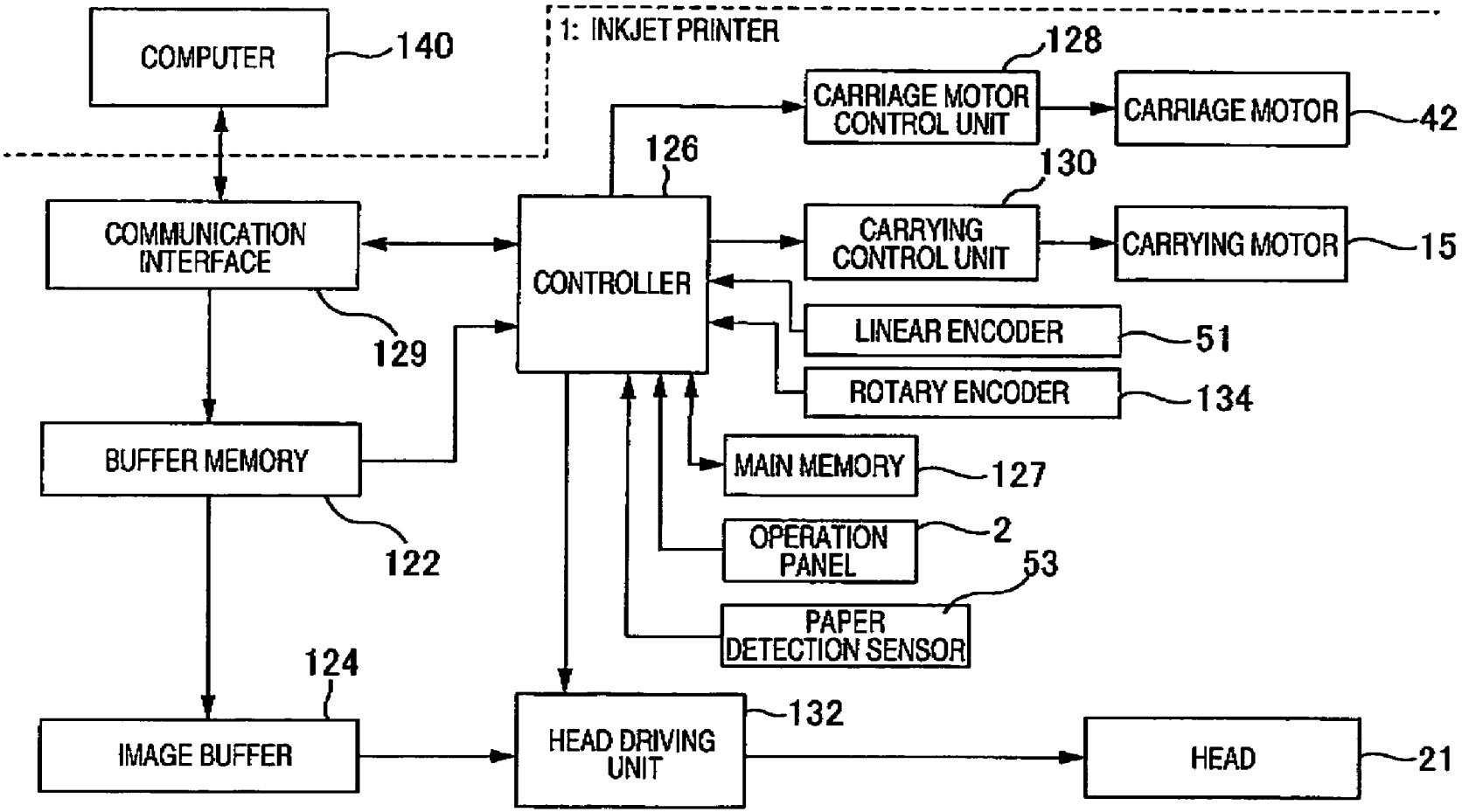
FIG. 4 is a block diagram illustrating the system configuration of the printing apparatus.

FIG. 3 illustrates the configuration of a carrying unit of the inkjet printer 1. FIG. 4 illustrates the system configuration of the inlet printer 1.

As shown in FIG. 1, the inkjet printer 1 has a structure in which a medium, such as a print sheet, supplied from a rear side of the inkjet printer 1 is ejected from a front side. An operation panel 2 and a paper ejection unit 3 are provided in a front part of the inkjet printer 1, and a paper feed unit 4 is provided in a rear part of the inkjet printer 1. Various kinds of operation buttons 5 and display lamps 6 are provided in the operation panel 2. In addition, the paper ejection unit 3 is provided with a paper ejection tray 7 that closes a paper ejection port when the inkjet printer 1 is not used. A paper feed tray 8 used to hold a medium, such as a cut sheet, thereon is provided in the paper feed unit 4.

As shown in FIG. 2, a carriage 41 is provided inside the inkjet printer 1. The carriage 41 is provided to be able to move relatively along the left and right direction. A carriage motor 42, a pulley 44, a timing belt 45, and a guide rail 46 are provided around the carriage 41. The carriage motor 42 is a DC motor, for example. The carriage motor 42 is a driving source for causing the carriage 41 to move relatively in the left and right direction (hereinafter, referred to as 'carriage movement direction'). The timing belt 45 is connected to the carriage motor 42 through the pulley 44. In addition, a part of the timing belt 45 is connected to the carriage 41, such that the carriage 41 is moved relatively along the carriage movement direction deft and right direction) due to rotary driving of the carriage motor 42. The guide rail 46 guides the carriage 41 along the carriage movement direction (left and right direction).

Further, a linear encoder 51 that detects the position of the carriage 41, a carrying roller 17A that carries a medium S in a direction crossing the movement direction of the carriage 41 (front and rear direction in the drawing; hereinafter, referred to as 'carrying direction'), and a carrying motor 15 that causes the carrying roller 17A to be rotatably driven are provided around the carriage 41.

Furthermore, an ink cartridge 48 that contains various kinds of ink therein and a head 21 that performs printing with respect to the medium S are provided in the carriage 41. The ink cartridge 48 contains ink corresponding to various colors, such as yellow (Y), a magenta (M), cyan (C), and black (K), and is detachably mounted in a cartridge mounting unit 49 provided in the carriage 41. Moreover, in the present embodiment, the head 21 ejects ink onto the medium S, such that printing with respect to the medium S is performed. Accordingly, many nozzles for ejecting ink are provided in the head 21.

In addition, the head 21 corresponds to a 'print head' that performs printing on the medium S. In addition, the guide rail 46 corresponds to a 'guide unit', since the guide rail 46 guides the carriage 41 (head 21) along a predetermined direction. Moreover, since the carriage motor 42 serves as a motor that causes the carriage 41 to move, the carriage motor 42 corresponds to a 'motor'.

In addition, the inkjet printer 1 includes a pumping device 31, which pumps ink out of nozzles in order to unclog the nozzles of the head 21, and a capping device 35 that caps the nozzles of the head 21 when printing is not performed (for example, while in a standby state) in order to prevent the nozzles of the head 21 from clogging.

Next, a carrying unit of the inkjet printer 1 will be described. As shown in FIG. 3, a paper feed roller 13, a paper detection sensor 53, the carrying roller 17A, a paper ejection roller 17B, a platen 14, and free rollers 18A and 18B are provided in the carrying unit.

The medium S to be printed is set in the paper feed tray 8. The medium S set in the body chassis 8 is carried along a direction indicated by arrow A in FIG. 3 by the paper feed roller 13 having an approximately D-shaped cross unit and then moves to the inside of the inkjet printer 1. The medium S carried to the inside of the inkjet printer 1 comes into contact with the paper detection sensor 53. The paper detection sensor 53 is provided between the paper feed roller 13 and the carrying roller 17A in order to detect the medium S carried by the paper feed roller 13.

The medium S detected by the paper detection sensor 53 is carried to the platen 14, in which printing is performed, one by one by the carrying roller 17A. The free roller 18A is provided opposite to the carrying roller 17A. The medium S is interposed between the free roller 18A and the carrying roller 17A so as to be carried smoothly.

The medium S carried to the platen 14 is sequentially printed in ink ejected from the head 21. The platen 14 is provided opposite to the head 21 so as to support the printed medium S from a bottom side.

The medium S that has been printed is ejected one by one to the outside of the printer by the paper ejection roller 17B. The paper ejection roller 17B is driven in synchronization with the carrying motor 15, such that the medium S interposed between the paper ejection roller 17B and the free roller 18B provided opposite to the paper ejection roller 17B is ejected to the outside of the printer.

System Configuration

Next, the system configuration of the inkjet printer 1 will be described. As shown in FIG. 4, the inkjet printer 1 includes a buffer memory 122, an image buffer 124, a controller 126, a main memory 127, a communication interface 129, a carriage motor control unit 128, a carrying control unit 130, and a head driving unit 132.

The communication interface 129 is used when the inkjet printer 1 performs data exchange with an external computer 140, such as a personal computer. The communication interface 129 is wireline or wireless connected with the external computer 140 so as to be communicable with the external computer 140, such that the communication interface 129 receives various kinds of data, such as print data, transmitted from the computer 140.

The various kinds of data, such as the print data, received through the communication interface 129 are temporarily stored in the buffer memory 122. Moreover, the print data stored in the buffer memory 122 is sequentially stored in the image buffer 124. The print data stored in the image buffer 124 is sequentially transmitted to the head driving unit 132. In addition, the main memory 127 is formed by using a ROM, a RAM, an EEPROM, or the like. Various kinds of programs, set data, and the like used to control the inkjet printer 1 are stored in the main memory 127.

The controller 126 reads a control program, various kinds of set data, and the like from the main memory 127 and makes an overall control on the inkjet printer 1 on the basis of the control program and various set data. Furthermore, detection signals from various sensors, such as a rotary encoder 134, the linear encoder 51, and paper detection sensor 53, are input to the controller 126.

When various kinds of data, such as print data, transmitted from the external computer 140 are received through the communication interface 129 and are then stored in the buffer memory 122, the controller 126 reads information, which is required from the stored data, from the buffer memory 122. On the basis of the read information, the controller 126 controls the carriage motor control unit 128, the carrying control unit 130, the head driving unit 132, and the like according to the control program while referring to an output from the linear encoder 51 or the rotary encoder 134.

The carriage motor control unit 128 performs driving control on the rotary direction, number of rotations, torque, and the like according to a command from the controller 126. The carrying control unit 130 controls the carrying motor 15, which drives the carrying roller 17A to rotate, according to the command from the controller 126.

The head driving unit 132 performs driving control on the nozzles, which correspond to respective colors and are provided in the head 21, on the basis of the print data stored in the image buffer 124 according to the command from the controller 126.

Moreover, in the present embodiment, since the carriage motor control unit 128 controls the carriage motor 42 for moving the carriage 41 (head 21), the carriage motor control unit 128 corresponds to a 'motor control unit'.

Head

Figure 5:
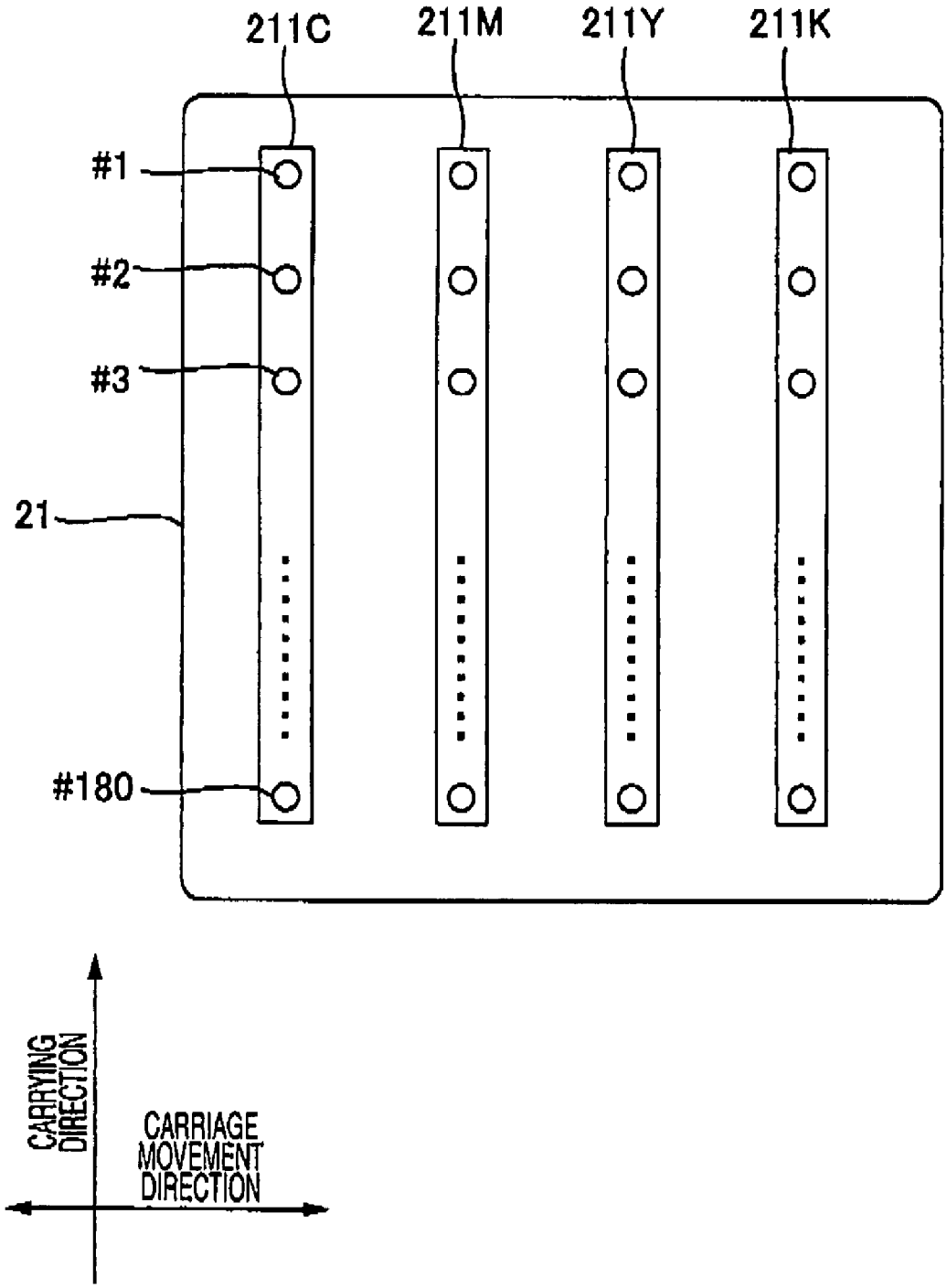
FIG. 5 is a plan view illustrating an example of a head of the printing apparatus.

FIG. 5 is a view illustrating the arrangement of nozzles for ink located at a lower surface of the head 21.

As shown in FIG. 5, nozzle rows each of which has a plurality of nozzles #1 to #180 and corresponds to each of the colors of yellow (Y), magenta (M), cyan (C), and black (K), that is, a cyan nozzle row 211C, a magenta nozzle row 211M, a yellow nozzle row 211Y, and a black nozzle row 211K are provided on the lower surface of the head 21.

The nozzles #1 to #180 of each of the nozzle rows 211C, 211M, 211Y, and 211K are linearly arranged in a row along a predetermined direction (here, direction in which the medium S is carried) with a distance therebetween. The nozzle rows 211C, 211M, 211Y, and 211K are arranged in parallel along a predetermined movement direction (scanning direction) of the head 21 with a distance therebetween. A piezoelectric element (not shown) is provided, as a driving element for ejecting ink droplets, in each of the nozzles #1 to #180.

Linear Encoder

Configuration of Encoder

Figure 6:
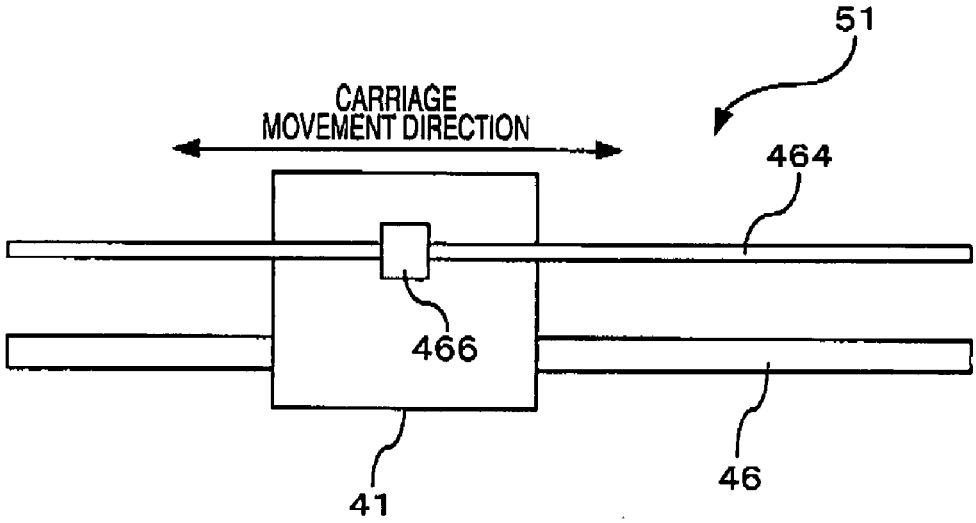
FIG. 6 is an explanatory view illustrating an example of a linear encoder.

FIG. 6 is a view schematically illustrating the configuration of the linear encoder 51. The linear encoder 51 includes a linear encoder code disc 464 and a detection unit 466. The linear encoder code disc 464 is fixed to a frame side inside the inkjet printer 1, as shown in FIG. 2. On the other hand, the detection unit 466 is fixed to the carriage 41 side. The detection unit 466 moves relatively along the linear encoder code disc 464 when the carriage 41 moves along the guide rail 46. Thus, the detection unit 466 detects an amount of movement of the carriage 41.

Configuration of Detection Unit

Figure 7:
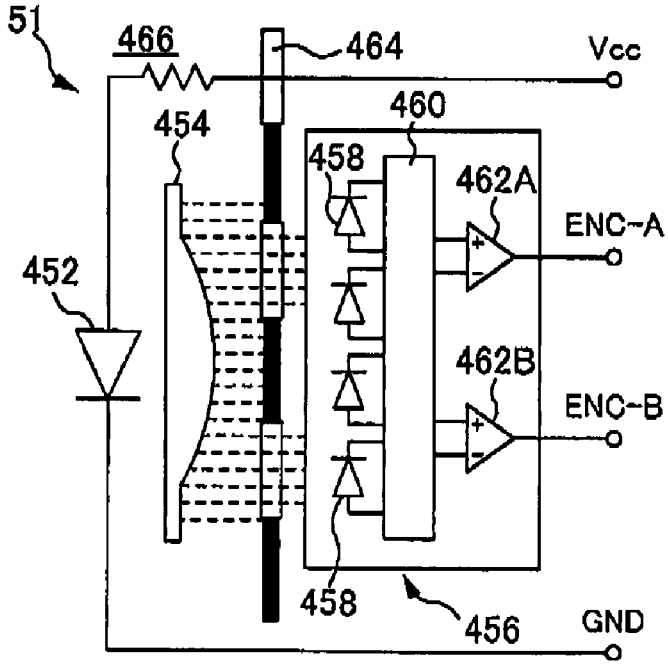
FIG. 7 is a view illustrating the configuration of a detection unit of a linear encoder.

FIG. 7 is a view schematically illustrating the configuration of the detection unit 466. The detection unit 466 includes a light emitting diode 452, a collimator lens 454, and a detection processing section 456. The detection processing section 456 includes (for example, four) photodiodes 458, a signal processing circuit 460, and (for example, two) comparators 462A and 462B.

When a voltage Vcc is applied to both ends of the light emitting diode 452 through a resistor, light beams are emitted from the light emitting diode 452. The light beams are condensed as parallel light beams by the collimator lens 454 and then pass through the linear encoder code disc 464. In the linear encoder code disc 464, slits are provided at predetermined distances (for example, 1/180 inch (1 inch=2.54 cm)).

The parallel light beams having passed through the linear encoder code disc 464 are incident on the photodiodes 458 through fixed slit (not shown) and are then converted to electrical signals. The electrical signals output from the four photodiodes 458 are subject to signal processing in the signal processing circuit 460. Then, the signals output from the signal processing circuit 460 are compared in the comparators 462A and 462B and then a result of the comparison is output as pulses. Pulses ENC-A and ENC-B output from the comparators 462A and 462B serve as output of the linear encoder 51.

Output Signal

Figure 8A:
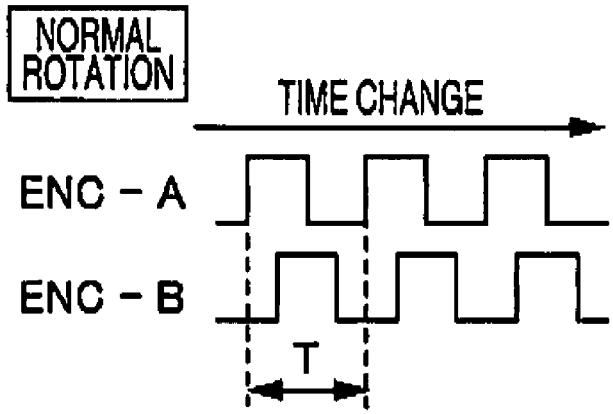
FIG. 8A is a timing chart illustrating the output waveform of a linear encoder at the time of normal rotation.
Figure 8B:
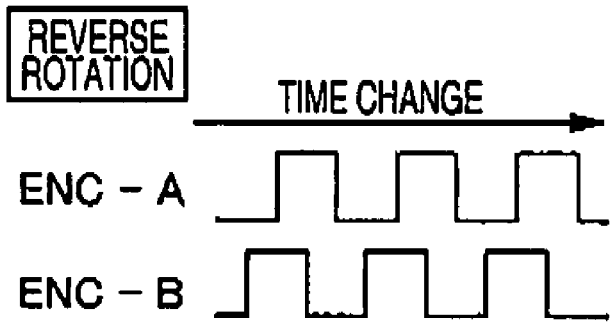
FIG. 8B is a timing chart illustrating the output waveform of a linear encoder at the time of reverse rotation.

FIGS. 8A and 8B are timing charts illustrating waveforms of two output signals of the detection unit 466 at the time of normal rotation and reverse rotation of the carriage motor 42, respectively. As shown in FIG. 8A and FIG. 8B, in any cases of the normal rotation and reverse rotation of the carriage motor 42, a phase difference between the pulses ENC-A and ENC-B is only 90 degrees. When the carriage motor 42 rotates normally, that is, when the carriage 41 moves along the guide rail 46, a phase of the pulse ENC-A leads that of the pulse ENC-B by 90 degrees, as shown in FIG. 8A. When the carriage motor 42 rotates reversely, the phase of the pulse ENC-A lags that of the pulse ENC-B by 90 degrees, as shown in FIG. 8B. In addition, a period T of each of the pulses ENC-A and ENC-B is equal to time taken when the carriage 41 moves by a distance between the slits of the linear encoder code disc 464.

In addition, rising edges of the output pulses ENC-A and ENC-B of the linear encoder 51 are detected, the number of the detected edges is counted, and the rotary position of the carriage motor 42 is calculated on the basis of the counted value. If one edge is detected while the carriage motor 42 is normally rotating, the counted number is incremented by '1'. In contrast, if one edge is detected while the carriage motor 42 is reversely rotating, the counted number is decremented by '−1'. The period of each of the pulses ENC-A and ENC-B is equal to time taken until a predetermined slit of the linear encoder code disc 464 passes the detection unit 466 and then a next slit passes the detection unit 466. In addition, the phase difference between the pulses ENC-A and ENC-B is only 90 degrees. For this reason, the counted value '1' in the counting corresponds to ¼ of the distance between the slits of the linear encoder code disc 464. Accordingly, by multiplying the counted value by ¼ of the distance between the slits, it is possible to obtain an amount of movement of the carriage motor 42, which has moved from a rotary position whose counted value corresponds to '0', on the basis of a value obtained as a result of the multiplication. At this time, the resolution of the linear encoder 51 is set to ¼ of the distance between the slits of the linear encoder code disc 464.

Carriage Motor Control Unit

Figure 9A:
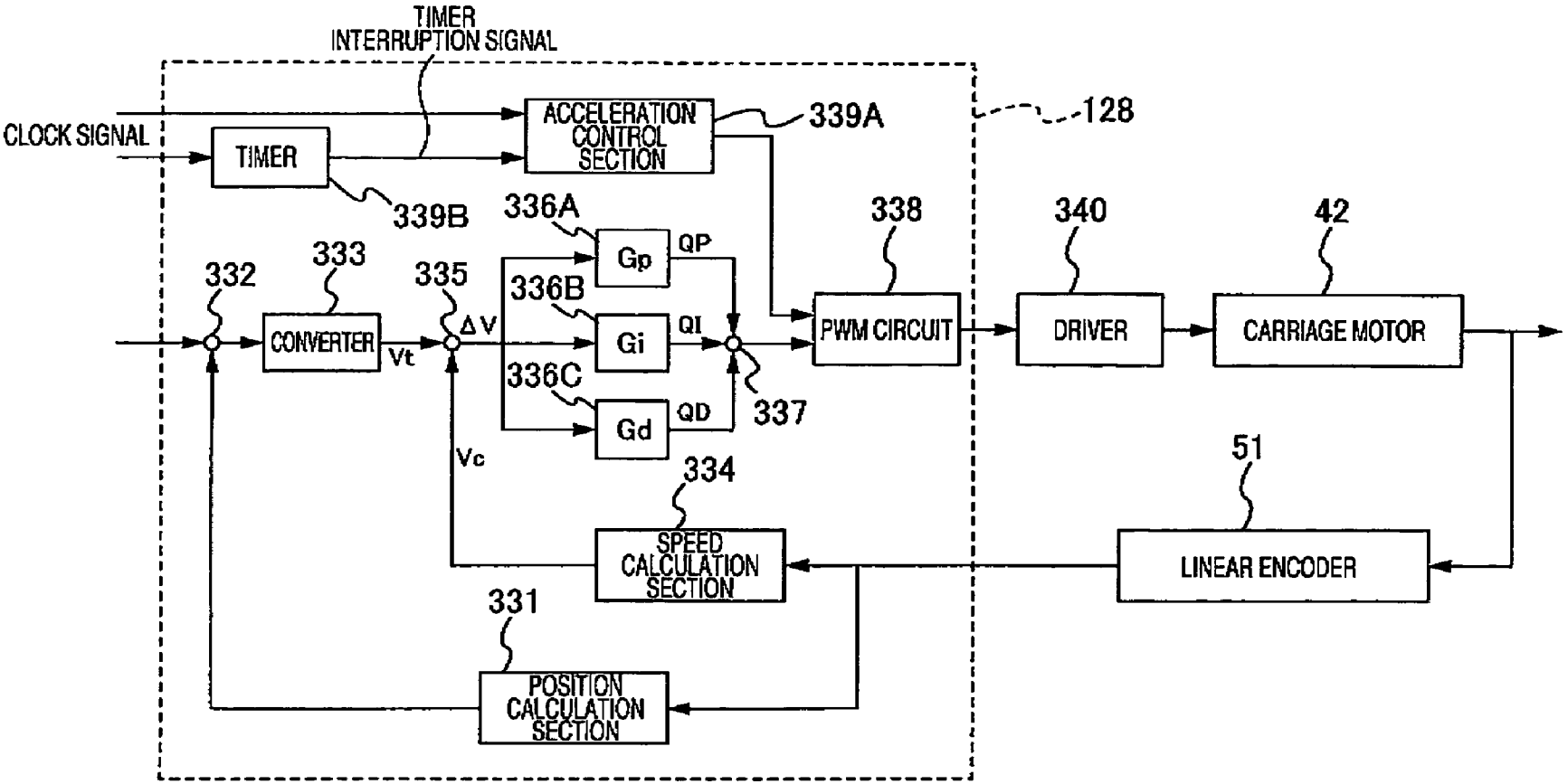
FIG. 9A is a block diagram illustrating an example of the circuit configuration of a carriage motor control unit 128.

Next, the configuration of the carriage motor control unit 128 will be described in detail. FIG. 9A is a block diagram illustrating an example of the circuit configuration of the carriage motor control unit 128. As shown in FIG. 9A, the carriage motor control unit 128 includes a position calculation section 331, a subtractor 332, a converter 333, a speed calculation section 334, a subtractor 335, a proportional element 336A, an integral element 336B, a derivative element 336C, an adder 337, a PWM circuit 338, an acceleration control section 339A, and a timer 339B.

The position calculation section 331 detects edges of pulses output from the linear encoder 51, counts the number of edges, and calculates the rotary position of the carriage motor 42 on the basis of the counted value. The position calculation section 331 recognizes the normal/reverse rotation of the carriage motor 42 through comparison processing of two pulse signals output from the linear encoder 51 and performs counting processing such that increment/decrement is carried out according to the normal/reverse rotation when one edge is detected.

The subtractor 332 calculates a position error between a target position transmitted from the controller 126 and a detected position detected by the position calculation section 331. The converter 333 outputs a target speed Vt corresponding to the position error output from the subtractor 332.

Figure 9B:
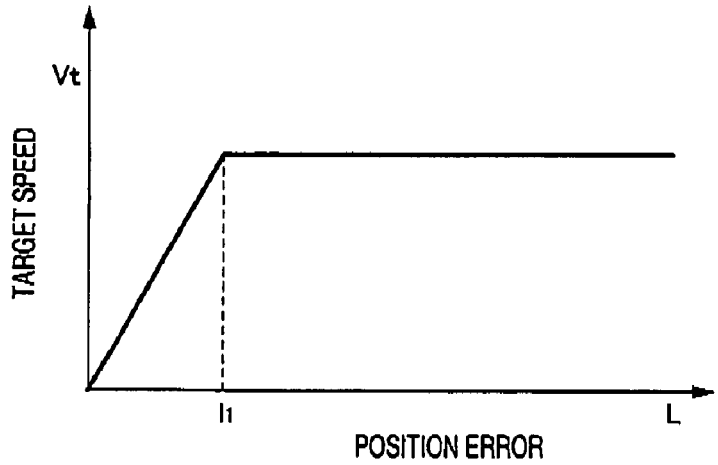
FIG. 9B illustrates target speed data indicating a target speed Vt that is output from a converter 333 corresponding to a position error.

FIG. 9B target speed data illustrating the target speed Vt that the converter 333 outputs corresponding to the position error. If the position error is a predetermined value or more, that is, a distance to a target position is a predetermined amount or more, the converter 333 outputs the target speed such that the carriage 41 moves at a constant target speed. Here, when the position error is larger than 11 at the time of low speed movement, the target speed is set to be 0.0127 (m/s).

The speed calculation section 334 measures a period of pulses output from the linear encoder 51 and calculates a rotation speed Vc of the carriage motor 42 on the basis of this pulse period.

The subtractor 335 calculates a speed error ΔV between the target speed Vt output from the converter 333 and a detection speed Vc detected by the speed calculation section 334.

The proportional element 336A multiplies the speed error ΔV by amplification factor Gp and outputs a proportional component QP. The integral element 336B integrates a result, which is obtained by multiplying the speed error ΔV by amplification factor Gi, with an operation result QI(j−1) immediately before, and outputs an integral component QI. The derivative element 336C multiplies a difference between a current speed error ΔV(j) (j indicates time) and a speed error ΔV(j−1), which is obtained by an operation performed immediately before, by amplification factor Gd, and outputs a differential component QD. In addition, the derivative element 336C is equivalent to a calculation section that calculates variation of the movement speed of a carriage (print head) per unit time. The calculations of the proportional element 336A, the integral element 336B, and the derivative element 336C are performed for every period of an output pulse of the linear encoder 51.

Here, calculation outputs of the calculation elements 336A, 336B, and 336C, that is, the proportional component QP, the integral component QI, and the differential component QD of the calculation elements 336A, 336B, and 336C can be expressed as following expressions (1) to (3), for example.

$$QP(j)=\Delta V(j)\times Gp \quad (1)$$

$$QI(j)=QI(j-1)+\Delta V(j)\times Gi \quad (2)$$

$$QD(j)=\{\Delta V(j)-\Delta V(j-1)\}\times Gd \quad (3)$$

The adder 337 adds the proportional component QP of the proportional element 336A, the integral component QI of the integral element 336B, and the differential component QD of the derivative element 336C. A result ΣQ obtained by adding the three components, that is, the proportional component QP, the integral component QI, and the differential component QD is output as a duty signal to the PWM circuit 338.

The addition result ΣQ can be obtained on the basis of the following expression (4).

$$\Sigma Q(j0=QP(j)+QI(j)+QDP(j) \quad (4)$$

The PWM circuit 338 generates a control signal corresponding to the addition result ΣQ of the adder 337. A driver 340 drives the carriage motor 42 on the basis of the control signal. The driver 340 has a plurality of transistors, for example. The driver 340 applies a voltage to the carriage motor 42 by turning on/off the transistors on the basis of the control signal from the PWM circuit 338.

Further, the acceleration control section 339A and the timer 339B are used when making an acceleration control on the carriage motor 42. The timer 339B generates a timer interruption signal for every predetermined period of time on the basis of a clock signal transmitted from the controller 126. Whenever the acceleration control section 339A receives a timer interruption signal, the acceleration control section 339A integrates a predetermined duty DXP. Then, the acceleration control section 339A generates a duty signal as an integration result, and outputs the duty signal to the PWM circuit 338.

In the case of performing accelerative driving for the carriage motor 42, the PWM circuit 338 generates a control signal on the basis of the duty signal output from the acceleration control section 339A, thereby controlling the carriage motor 42. In addition, in the case of driving the carriage motor 42 at the constant speed and performing deceleration driving for the carriage motor 42, the PWM circuit 338 outputs the carriage motor 42 the control signal, which is generated on the basis of the duty signal that is output from the adder 337 as the addition result ΣQ of the three components, that is, the proportional component QP of the proportional element 336A, the integral component QI of the integral element 336B, and the differential component QD of the derivative element 336C, thereby controlling the carriage motor 42.

Method of Driving a Carriage Motor

Figure 10A:
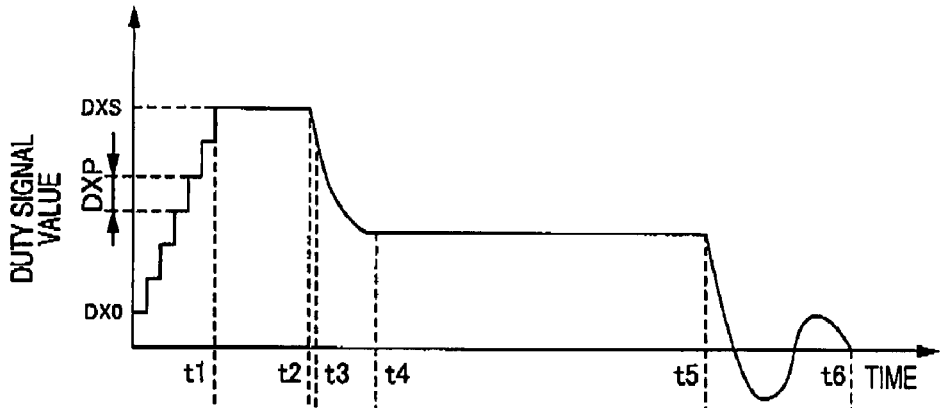
FIG. 10A is a graph illustrating that a duty signal changes with time.
Figure 10B:
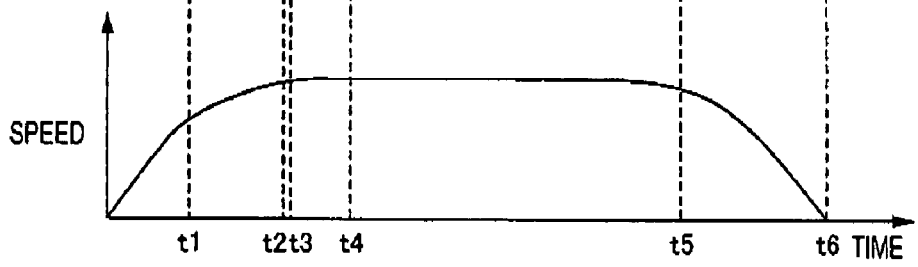
FIG. 10B is a graph illustrating the speed change of a motor.

FIG. 10A illustrates a graph where a duty signal input to the PWM circuit 338 changes with time. FIG. 10B is a graph illustrating a speed change of the carriage motor 42. Hereinafter, driving of the carriage motor 42 will be described using FIGS. 10A and 10B.

If a starting command signal that causes the carriage motor 42 to start operating is transmitted from the controller 126 to the carriage motor control unit 128 under a state in which the carriage motor 42 stops, an initial duty signal whose signal value is DXO is transmitted from the acceleration control section 339A to the PWM circuit 338. The initial duty signal is transmitted from the controller 126 to the acceleration control section 339A together with the starting command signal. Then, the initial duty signal is converted into control signal corresponding to the signal value DXO by the PWM circuit 338, such that the carriage motor 42 starts to operate.

After the carriage motor control unit 128 receives the starting command signal, the timer 339B generates a timer-interruption signal for every predetermined period of time. Whenever the acceleration control section 339A receives the timer interruption signal, the acceleration control section 339A integrates the signal value of the initial duty signal with a predetermined duty DXP and then transmits to the PWM circuit 338 a duty signal having the integrated duty as a signal value. The duty signal is converted into a control signal corresponding to the signal value by the PWM circuit 338, and thus the rotation speed of the carriage motor 42 increases. For this reason, values of the duty signal transmitted from the acceleration control section 339A to the PWM circuit 338 rise in a stepwise manner.

Integration processing on the duty in the acceleration control section 339A is performed until the integrated duty becomes a predetermined duty DXS. When the duty integrated at time t1 reaches the predetermined value DXS, the acceleration control section 339A stops the integration processing and then transmits to the PWM circuit 338 a duty signal having a fixed duty DXS as a signal value.

Then, when the carriage motor 42 reaches a predetermined rotation speed (refer to time t2), the acceleration control section 339A decreases the duty signal output to the PWM circuit 338 so as to makes a control such that the duty percent of a voltage applied to the carriage motor 42 is reduced. At this time, the rotation speed of the carriage motor 42 rises further. Thereafter, at time t3, the PWM circuit 338 selects an output of the adder 337, such that PID control is performed. At a point of time (t3) when the PID control starts, an integral value of the integral element 336B is set as an appropriately value and an output value of the integral element 336B reaches a predetermined value.

If the PID control starts, the subtractor 332 outputs to the converter 333 a position error between the target position of the carriage 41 and the current position of the carriage 41 obtained from the output of the linear encoder 51. The converter 333 obtains the target speed Vt from the position error referring to the above-mentioned target speed data and then outputs the target speed Vt to the subtractor 335. Then, the carriage motor control unit 128 calculates the proportional component QP, the integral component QI, and the differential component QD on the basis of the speed error ΔV between the target speed Vt and the actual speed Vc obtained from the output of the linear encoder 51 by using the proportional element 336A, the integral element 336B, and the derivative element 336C. The carriage motor control unit 128 controls the carriage motor 42 on the basis of the sum ΣQ of the calculation results. In addition, the proportional calculation, the integral calculation, and the differential calculation are performed in synchronization with a rising edge of an output pulse ENC-A of the linear encoder 51, for example. Thus, the rotation speed of the carriage motor 42 is controlled to become a desired rotation speed at time t4.

As the carriage motor 42 approaches the target rotation position (time t5), the position error decreases, and accordingly, the target rotation speed is also reduced. As a result, the speed error, that is, an output of the subtractor 335 becomes negative, and thus the carriage motor 42 slows down and stops at time t6.

Printing Operation

Figure 11:
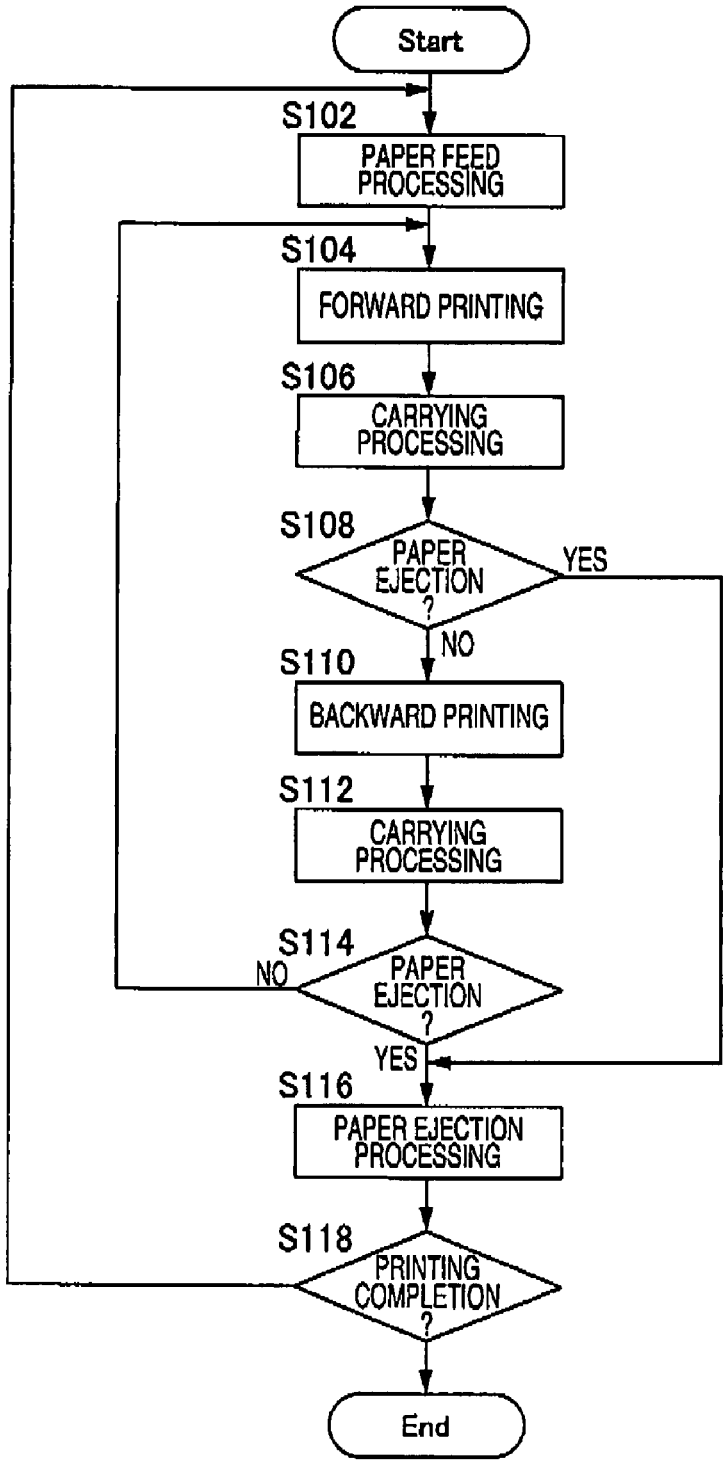
FIG. 11 is a flow chart explaining an example of printing processing.

Next, a printing operation of the inkjet printer 1 will be described. Here, 'bidirectional printing' will be described as an example. FIG. 11 is a flow chart illustrating an example of procedures of a printing operation of the inkjet printer 1. Various kinds of processing to be described below are executed by causing the controller 126 to read a program from the main memory 127 and to control the carriage motor control unit 128, the carrying control unit 130, the head driving unit 132, and the like according to the program.

First, when print data is received from the computer 140, the controller 126 performs paper feed processing in order to perform printing on the basis of the pint data (S102). In the paper feed processing, the medium S to be printed is fed inside the inkjet printer 1 until the medium S is carried up to the printing start position (also referred to as a 'head position). The controller 126 rotates the paper feed roller 13 such that medium S to be printed is carried up to the carrying roller 17A. The controller 126 rotates the carrying roller 17A such that the medium S carried from the paper feed roller 13 is positioned at the printing start position (near an upper part of the platen 14).

Then, the controller 126 causes the carriage motor 42 to be driven through the carriage motor control unit 128 such that the carriage 41 moves relatively with respect to the medium S, thereby executing print processing. Here, forward printing is performed in which ink is ejected from the head 21 while the carriage 41 moves along the guide rail 46 in one direction (S104). The controller 126 drives the carriage motor 42 so as to move the carriage 41 and also drives the head 21 on the basis of the print data so as to eject ink. The ink ejected from the head 21 reaches the medium S to be formed as dots.

After printing as described above, the controller 126 executes carrying processing of carrying the medium S by a predetermined amount (S106). Here, the controller 126 drives the carrying motor 15 through the carrying control unit 130 so as to rotate the carrying roller 17A, such that the medium S is carried in the carried direction relatively with respect to the head 21. Through the carrying processing, the head 21 can perform printing in a region different from a region printed immediately before.

After the carrying processing described above, the controller 126 determines whether or not to eject the medium S (S108). In this case, if there is no other data to be printed on the medium S, the controller 126 executes paper ejection processing (S116). On the other hand, if there is other data to be printed on the medium S, the controller 126 executes backward printing without executing the paper ejection processing (S110). In the backward printing, printing is performed by causing the carriage 41 to move along the guide rail 46 in a direction opposite to that in the forward printing. Even In this case, the controller 126 drives the carriage motor 42 to rotate in the direction opposite to that described in the above case through the carriage motor control unit 128 so as to move the carriage 41 and also drives the head 21 on the basis of the print data so as to cause ink to be ejected, thereby perform printing.

After executing the backward printing, carrying processing is executed (S112) and then determination on paper ejection is made (S114). In this case, if there is other data to be printed on the medium S, the paper ejection processing is not performed but the process returns to the step S104 in which the forward printing is performed again (S104). On the other hand, if there is other data to be printed on the medium S, the controller 126 executes paper ejection processing (S116).

After the paper ejection processing, the controller 126 makes a print completion determination to determine whether or not the printing is completed (S108). Here, it is checked whether or not there is the medium S to be printed next on the basis of the print data from the computer 140. In this case, if there is the medium S to be printed next, the process returns to the step S102 in which paper feed processing is performed again to start printing. On the other hand, if there is no medium S to be printed next, the print processing is completed.

Stick-Slip Operation

In the inkjet printer 1 described above, for example, when the inkjet printer 1 has not been used for a long period of time, the carriage 41 (print head) does not slide smoothly along the guide rail 46 but the movement speed of the carriage 41 periodically increases or decreases or the carriage 41 repeats moving and stopping operations. That is, the stick-slip operation occurs.

The stick-slip operation refers that the speed periodically increases or decreases. In an extreme case, the carriage 41 repeats moving and stopping, that is, a jerky sliding motion occurs. This stick-slip operation is also called fixed sliding. As a main cause of the stick-slip operation, for example, a difference between static friction coefficient and dynamic friction coefficient of a sliding part located between the carriage 41 and the guide rail 46 that guides the carriage 41 may be considered. That is, since the static friction coefficient of the sliding part between the carriage 41 and the guide rail 46 is extremely larger than the dynamic friction coefficient, the carriage 41 does not easily move even if the torque of the carriage motor 42 increases. Then, the torque of the carriage motor 42 increases up to a predetermined value, the carriage 41 starts to move. As the carriage 41 starts to move, the movement speed of the carriage 41 rapidly rises because the dynamic friction coefficient is low. If the movement speed of the carriage 41 rises rapidly, the carriage motor control unit 128 puts a rapid brake on the carriage motor 42 in order to suppress the movement speed of the carriage 41. As a result, the carriage 41 stalls.

Figure 12:
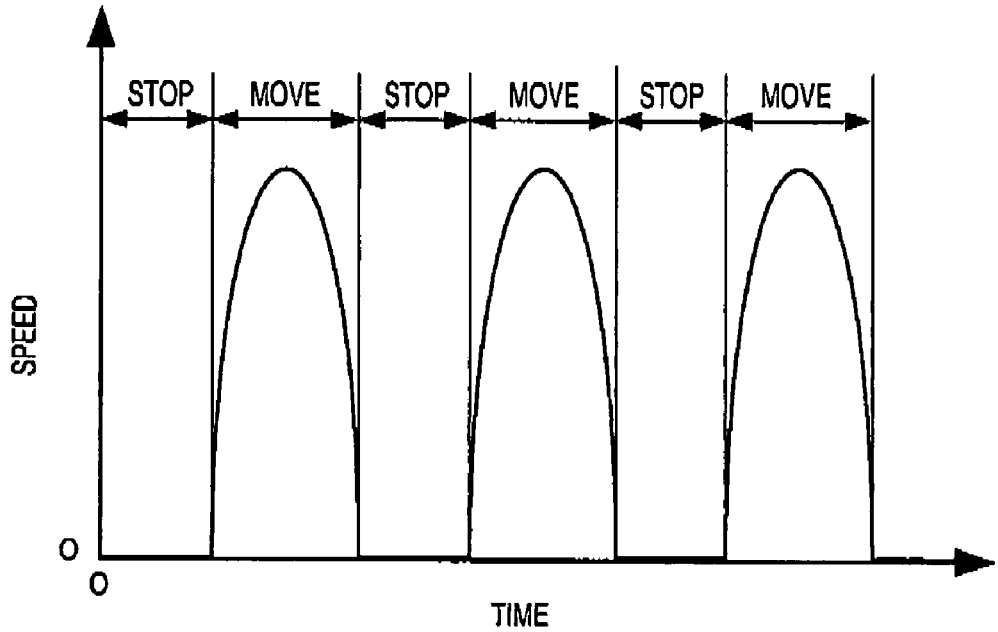
FIG. 12 is a view explaining the change of a movement speed when a carriage has performed a stick-slip operation.

FIG. 12 illustrates an example of a change of the movement speed of the carriage 41 when the carriage 41 performs the stick-slip operation. As shown in FIG. 12, the carriage 41 does not start to move until the torque of the carriage motor 42 becomes large up to a predetermined value.

If the movement speed of a carriage 41 reaches zero, a starting command signal is generated from the controller 126. If the starting command signal is generated, the PWM circuit 338 selects an output from the acceleration control section 339A. Moreover, the acceleration control section 339A keeps increasing a duty signal value by DXP with an initial value as DX0. Then, when the duty signal value becomes DXP, the PWM circuit 338 selects an output of the adder 337, such that the carriage motor 42 is controlled by the PID control.

The movement speed of the carriage 41 is detected by the speed calculation section 334 (refer to FIG. 9A). The carriage motor control unit 128 monitors the movement speed of the carriage 41 through the speed calculation section 334. If the movement speed of the carriage 41 does not rise, the carriage motor control unit 128 makes a control of raising the torque of the carriage motor 42 in order to move the carriage 41. Then, when the torque of the carriage motor 42 reaches a predetermined value, the carriage 41 starts to move and the movement speed of the carriage 41 rises rapidly. If the movement speed of the carriage 41 rises and reaches a predetermined level, the carriage motor control unit 128 puts a brake on the carriage motor 42 in order to suppress the movement speed of the carriage 41. Then, the movement speed of the carriage 41 decreases, and as a result, the carriage 41 stalls to stop again.

If the carriage 41 stops, the starting command signal is generated again from the controller 126. Then, acceleration control is performed again by the acceleration control section 339A, and then when the duty signal value reaches a predetermined level, shifting to the PID control is performed. Thereafter, the carriage motor control unit 128 makes a control of raising the torque of the carriage motor 42 again in order to move the carriage 41. Thus, if the carriage 41 starts to move again and the movement speed of the carriage 41 increases rapidly, the carriage 41 stalls to stop again. Such moving and stopping operations are repeated alternately.

Case in which Stick-Slip Operation Occurs

The stick-slip operation of the carriage 41 occurs in a case in which the carriage motor control unit 128 causes the carriage 41 to move at the constant speed equal to or lower than a predetermined speed through the carriage motor 42. That is, when the carriage 41 moves at the constant speed higher than the predetermined speed, that is, when the carriage 41 moves at an extremely high speed at the time of execution of printing, the stick-slip operation is hardly generated. Here, the predetermined speed refers to an upper limit speed at which the carriage 41 may perform the stick-slip operation.

As cases in which the carriage 41 moves at the constant speed equal to or lower than the predetermined speed at which the stick-slip operation occurs, there are following cases (1) to (4), for example.

(1) At the Time of Replacing Ink Cartridge

There is case in which the ink cartridge 48 (refer to FIG. 2) mounted in the carriage 41 is replaced by a user or the like. When the ink cartridge 48 is replaced by the user or the like, it is necessary to move the carriage 41 to a predetermined position so that the ink cartridge 48 can be easily replaced by the user or the like. In this case, in order to prevent the user or the like from carelessly coming in contact with the carriage 41, it is necessary to cause the carriage 41 to move at the predetermined speed or less, that is, at the low speed.

(2) At the Time of Capping

There is a case in which the carriage 41 moves up to a position at which the capping device 35 (refer to FIG. 2) is provided When printing is not performed (for example, in a standby state), in order to prevent the nozzles #1 to #180 of the head 21 from dogging, the carriage 41 moves up to the position at which the capping device 35 is provided such that an operation of capping the nozzles #1 to #180 of the head 21 is performed. In this case, the carriage 41 is slowly carried at a speed equal to or lower than a predetermined speed (3) At the Time of Supply of Power When power is supplied, the carriage 41 is separated from the capping device 35 in order to prepare printing, for example, to clean the nozzles #1 to #180 of the head 21, thereby starting an initial operation an this case, the carriage 41 is slowly carried at a speed equal to or lower than the predetermined speed Moreover, setting of a region where the stick-slip operation, which will be described later, is also performed at the time of supply of power. At this time, the carriage 41 is slowly carried at the speed equal to or lower than the predetermined speed.

(4) At the Time of Detecting the Paper Width

The carriage 41 moves along the guide rail 46 in order to detect the width of the medium S, which is to be printed from now by the inkjet printer 1, by an optical sensor (not shown) provided in the carriage 41. At this time, in order to examine the width of the medium S with high precision, the carriage 41 is slowly carried at the speed equal to or lower than the predetermined speed.

In addition, as the cases in which the carriage 41 moves at the constant speed equal to or lower than the predetermined speed at which the stick-slip operation occurs, there may be cases other than the above cases (1) to (4).

Method of Determining Stick-Slip Operation

When the carriage 41 performs the stick-slip operation, a trouble has occurred in which the carriage 41 does not stop at the target position but comes and goes around the target position. In addition, when the stick-slip operation occurred, there was a case in which it took time until the carriage 41 stopped at the target position. Therefore, when the carriage 41 performs the stick-slip operation, it has been necessary to detect the stick-slip operation so as to promptly cope with the stick-slip operation.

In the inkjet printer 1 according to the present embodiment, in order to promptly cope with the case in which the carriage 41 performs the stick-slip operation, it is possible to make a determination on whether or not the carriage 41 has performed the stick-slip operation. In addition, the determination on whether or not the carriage 41 has performed the stick-slip operation is made by the controller 126. As methods of making the determination on the stick-slip operation, there are following methods (1) to (4), for example.

(1) Determination Based on Movement Speed

Figure 13A:
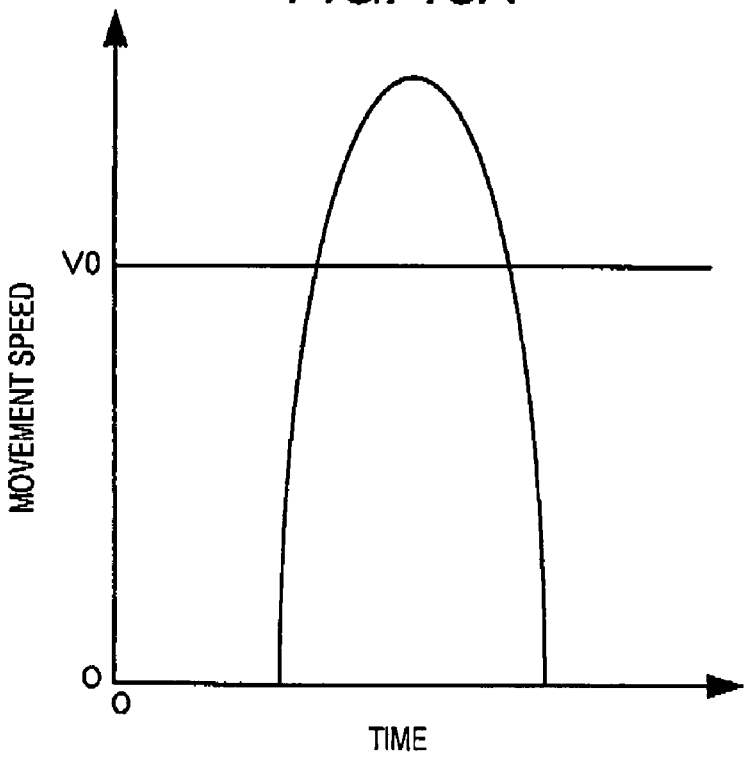
FIG. 13A is an explanatory view illustrating an example of a method of determining a stick-slip operation on the basis of a movement speed.

The determination on whether or not the carriage 41 performs the stick-slip is made on the basis of the movement speed of the carriage 41. As the determination method described above, there is a method of determining that the carriage 41 performs the stick-slip operation when the movement speed of the carriage 41 exceeds a predetermined threshold value V0. When the carriage 41 has performed the stick-slip operation, the movement speed of the carriage 41 rises rapidly as the carriage 41 starts to move, as is explained in FIG. 13A. At this time, the movement speed of the carriage 41 reaches a speed much faster than an original movement speed of the carriage 41. Thus, by setting the predetermined appropriate threshold value V0 and then examining whether or not the movement speed of the carriage 41 exceeds the predetermined threshold V0, it is possible to easily check whether or not the carriage 41 has performed the stick-slip operation.

Figure 13B:
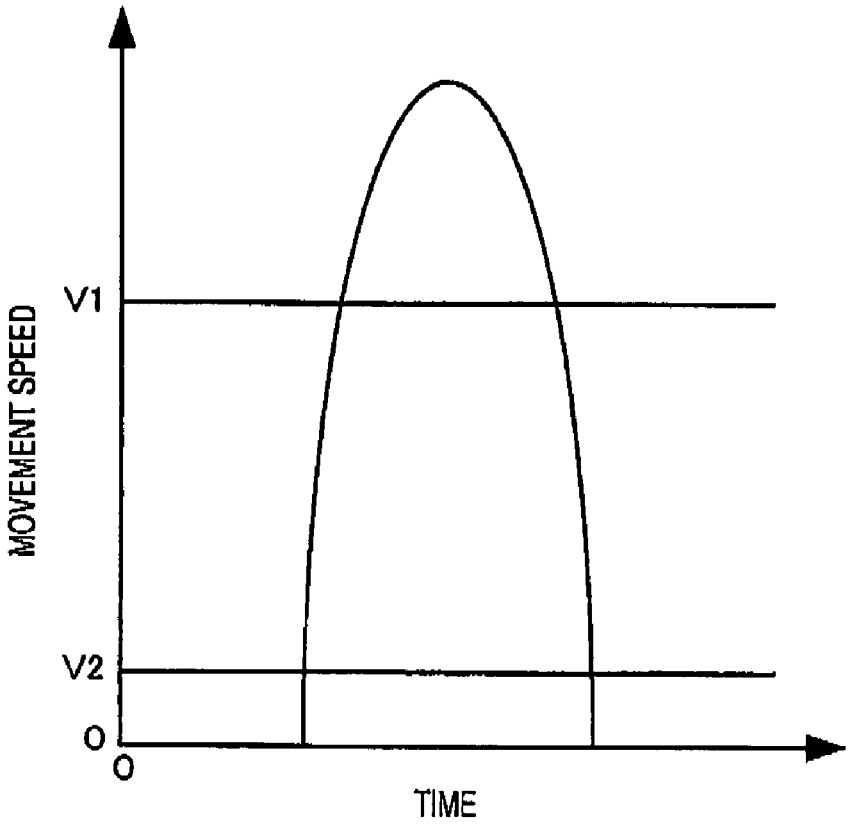
FIG. 13B is an explanatory view illustrating another example of a method of determining a stick-slip operation on the basis of a movement speed.

In addition, as the method of determining whether or not the carriage 41 has performed the stick-slip operation on the basis of the movement speed of the carriage 41, there is a method of determining the carriage 41 performs the stick-slip operation when the movement speed of the carriage 41 exceeds a predetermined allowed upper-limit value V1 and then drops below a predetermined allowed lower-limit value V2, which is described in FIG. 13B. When the carriage 41 has performed the stick-slip operation, the movement speed of the carriage 41 rises rapidly as the carriage 41 starts to move and then drops rapidly, as shown in FIG. 13B. Eventually, the carriage 41 may stall to almost stop. The movement speed of the carriage 41 reaches a speed much faster than the allowed upper limit value V1 of the movement speed of the carriage 41 that is originally assumed, and then drops rapidly to reach a speed (stop state is also included) lower than the allowed lower-limit value V2 of the movement speed of the carriage 41. Thus, it is possible to easily determine whether or not the carriage 41 has performed the stick-slip operation.

Further, the determination on whether or not the carriage 41 has performed the stick-slip operation may be made in other ways. For example, if the number of times for which the movement speed of the carriage 41 has exceeded the predetermined threshold value V0 is counted and the counted number of times exceeds the predetermined number of times (for example, twice), it may be possible to determine that the carriage 41 performs the stick-slip operation. Alternatively, if the number of times in which the movement speed of the carriage 41 has exceeded the predetermined allowed upper-limit value V1 and then dropped below the predetermined allowed lower-limit value V2 is counted and the counted number of times exceeds the predetermined number of times (for example, twice), it may be possible to determine that the carriage 41 performs the stick-slip operation.

(2) Determination Based on a Control Signal

The determination on whether or not the carriage 41 has performed the stick-slip operation is made on the basis of a control signal that the carriage motor control unit 128 generates to control the carriage motor 42. In this case, the determination is made on the basis of, for example, a duty signal input to the PWM circuit 338 (refer to FIG. 9A) of the carriage motor control unit 128, which is used as the control signal.

Figure 14A:
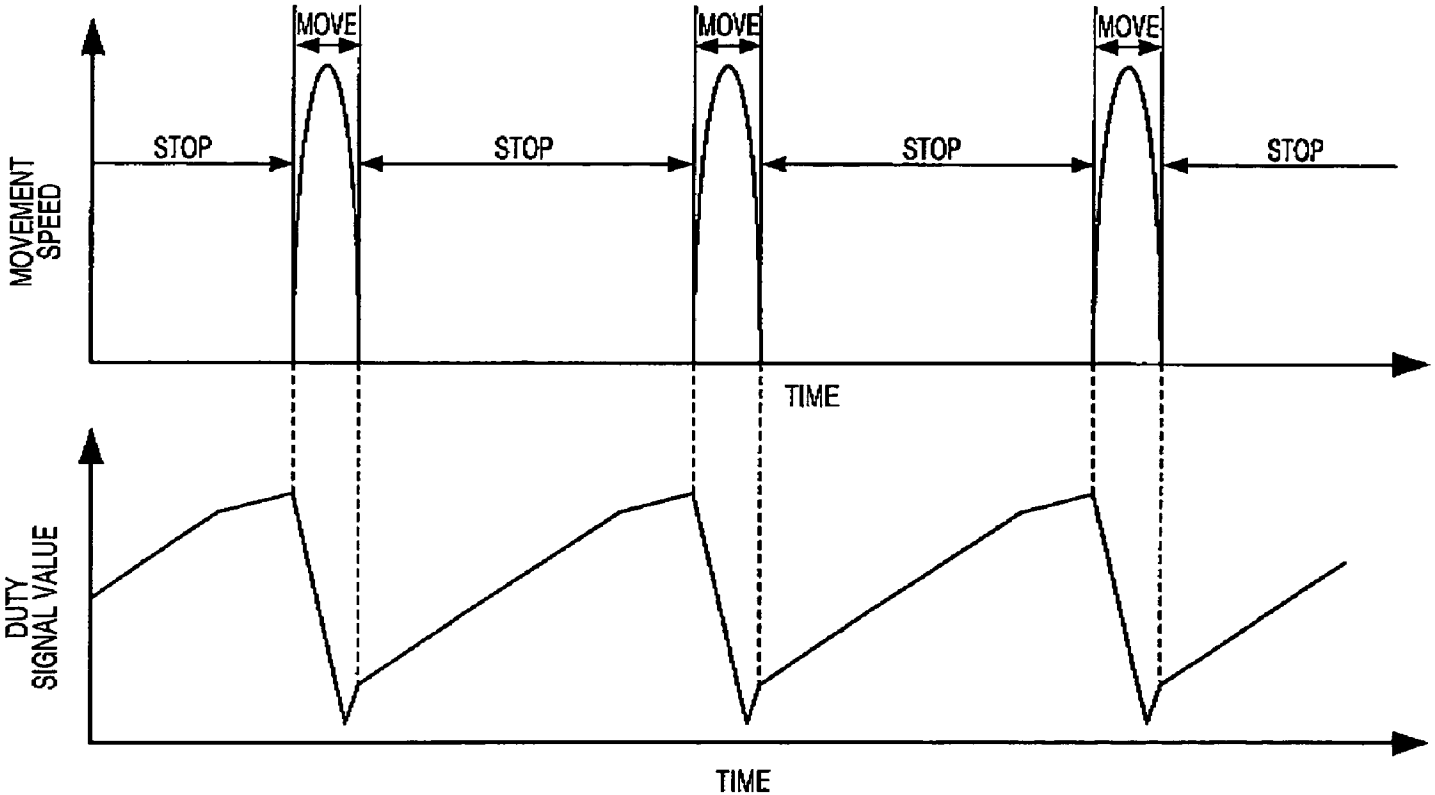
FIG. 14A is a view explaining the relationship between the movement speed of a carriage and a signal value of a duty signal at the time of a stick-slip operation.

FIG. 14A is a view explaining the relationship between the movement speed of the carriage 41 when the carriage 41 has performs the stick-slip operation and a signal value of the duty signal input to the PWM circuit 338. When the carriage 41 has performed the stick-slip operation, the movement speed of the carriage 41 rises rapidly and then drops rapidly, as shown in the upper part of FIG. 14A. Then, the carriage 41 repeats the moving and stopping operations alternately.

On the other hand, the duty signal value is as follows. When the speed of the carriage 41 rises from zero (that is, the carriage motor 42 stops), a starting command signal is generated from the controller 126. Then, the PWM circuit 338 of the carriage motor control unit 128 selects an output of the acceleration control section 339A. Moreover, the acceleration control section 339A outputs the initial duty value DX0 to the PWM circuit 338. Thereafter, the duty signal rises as much as increment of the predetermined value DXP by the acceleration control made by the acceleration control section 339A until the duty signal reaches a predetermined value. Then, if the duty signal value reaches the predetermined value DXS, the PWM circuit 338A selects an output (PID control) from the adder 337 from the output of the acceleration control section 339A.

In addition, while the control of the acceleration control section 339A is being made, it looks like the duty signal value continuously increases. However, since the duty signal value is incremented every 4 (ms), it looks like the duty signal value continuously increases in macroscopic view. In actuality, the duty signal value increases in a stepwise manner.

Even after selecting the PID control, the carriage 41 does not start to move. Therefore, the duty signal value continues to increase even though increment is smaller than that in the case of the control made by the acceleration control section 339A. If the duty signal value continuously increases, the movement speed of the carriage 41 rises rapidly at a certain point of time. Then, the carriage motor control unit 128 causes the signal value of the duty signal input to the PWM circuit 338 to rapidly drop in order to suppress the movement speed of the carriage 41. As a result, the speed of the carriage 41 drops rapidly. Then, the carriage motor control unit 128 makes a control of rapidly increasing the duty value in order to change the speed of the carriage 41 to a predetermined speed. However, time is not enough to decrease the carriage 41, and as a result, the carriage 41 stops.

When the carriage 41 stops and the movement speed reaches zero, the starting command signal is generated again from the controller and the PWM circuit 338 selects the acceleration control, which is made by the acceleration control section 339A, from the PID control. The acceleration control section 339A outputs the signal value DX0 of the initial duty signal. Then, the acceleration control section 339A gradually raises the signal value of the duty signal with the increment of DXP. Thereafter, even though the control is shifted to the PID control, the movement speed of the carriage 41 rises again rapidly at a certain time. Accordingly, the carriage motor control unit 128 quickly reduces a driving force of the carriage motor 42, such that the carriage 41 stops again.

Thus, the signal value of the duty signal input to the PWM circuit 338 repeats increase and decrease.

Here, as the method of determining whether or not the carriage 41 has performed the stick-slip operation, a method is actually used in which a maximum value Vmax and minimum value Vmin of the signal value of the duty signal input to the PWM circuit 338 are examined and then the determination on whether or not the carriage 41 has performed the stick-slip operation is made on the basis of a difference ΔV between the maximum value Vmax and the minimum value Vmin. That is, it is checked whether or not the difference ΔV between the maximum value Vmax and the minimum value Vmin of the signal value of the duty signal has exceeded the predetermined threshold value V0, and then it is determined that the carriage 41 has performed the stick-slip operation if the difference ΔV exceeds the predetermined threshold value V0. On the other hand, when the difference ΔV between the maximum value Vmax and the minimum value Vmin of the signal value of the duty signal has not exceeded the predetermined threshold value V0, it is determined that the carriage 41 has not performed the stick-slip operation.

Figure 14B:
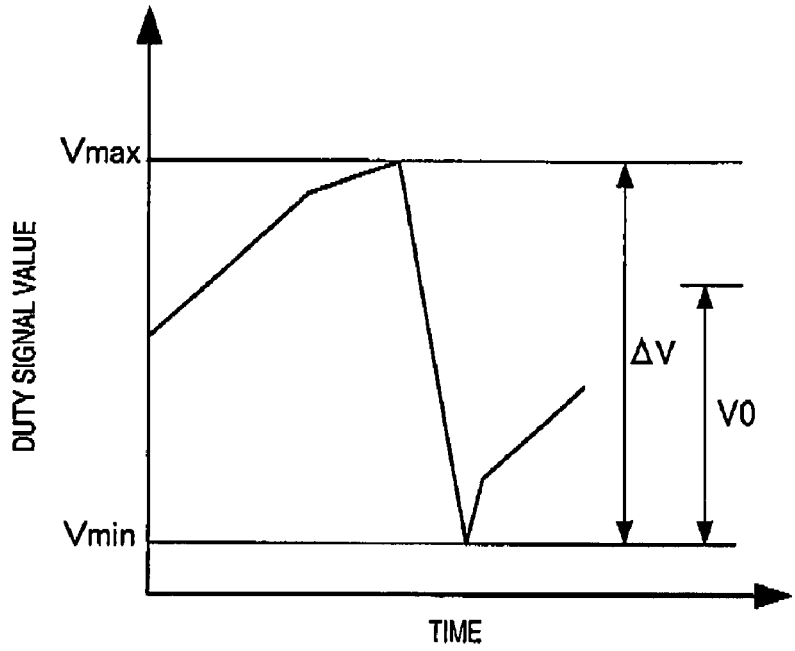
FIG. 14B is an explanatory view illustrating an example of a method of determining a stick-slip operation on the basis of a signal value of a duty signal.

FIG. 14B is a view illustrating an example of the determination method in detail. First, the maximum value Vmax and the minimum value Vmin of the signal value of the duty signal are acquired. Then, the difference ΔV between the acquired maximum value Vmax and minimum value Vmin is calculated. As shown in FIG. 14B, when the carriage 41 has performed the stick-slip operation, the difference ΔV between the maximum value Vmax and the minimum value Vmin of the signal value of the duty signal is large. By comparing the difference ΔV with the predetermined threshold value V0 that is set beforehand, it is possible to simply determine whether or not the carriage 41 has performed the stick-slip operation.

Furthermore, the determination on whether or not the carriage 41 has performed the stick-slip operation may be made in other ways. For example, if a case in which the difference ΔV between the maximum value Vmax and the minimum value Vmin of the signal value of the duty signal input to the PWM circuit 338 exceeds the predetermined threshold value V0 occurs for the predetermined number of times (for example, twice), it may be possible to determine that the carriage 41 performs the stick-slip operation.

Moreover, as the method of determining whether or not the carriage 41 has performed the stick-slip operation on the basis of a control signal, other methods may be used for the determination in addition to the determination based on the difference ΔV between the maximum value Vmax and the minimum value Vmin of the signal value of the duty signal.

(3) Determination Based on Acceleration

Here, the determination on whether or not the carriage 41 performs the stick-slip is made on the basis of acceleration of the carriage 41. In this case, the acceleration is acquired by the speed calculation section 334 refer to FIG. 9A) of the carriage motor control unit 128. That is, the speed calculation section 334 periodically outputs the movement speed of the carriage 41, which is detected on the basis of the output from the linear encoder 51, at predetermined intervals. The controller 126 acquires the acceleration of the carriage 41 from a difference of the movement speed of the carriage 41 periodically transmitted from the speed calculation section 334, and then determines whether or not the carriage 41 has performed the stick-slip operation on the basis of the difference.

Figure 15:
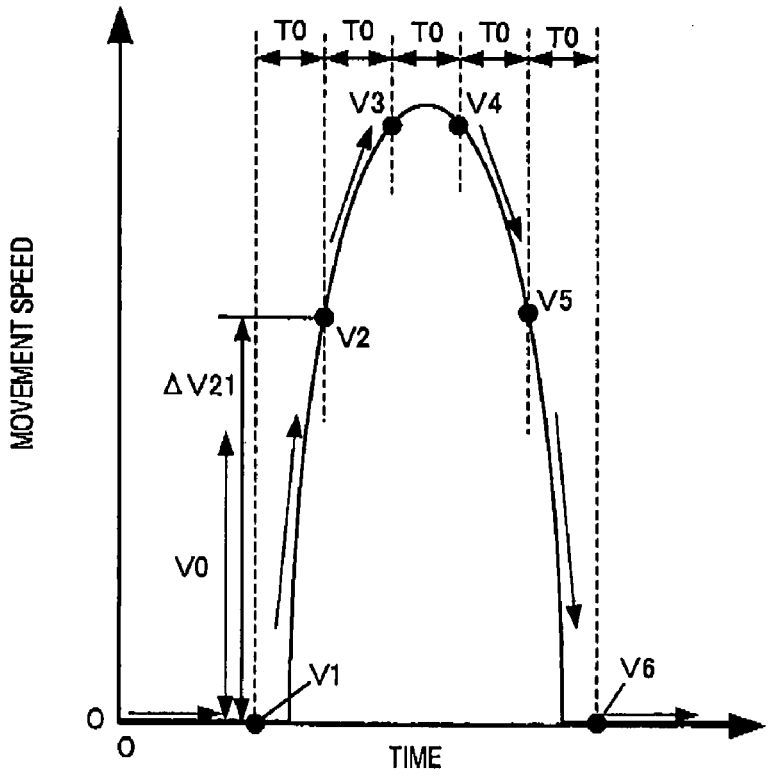
FIG. 15 is an explanatory view illustrating an example of a method of determining a stick-slip operation on the basis of acceleration.

FIG. 15 is a view illustrating an example of the method of determining whether or not the carriage 41 has performed the stick-slip operation on the basis of the acceleration of the carriage 41. As shown in FIG. 15, when the carriage 41 has performed the stick-slip operation, the movement speed of the carriage 41 rises rapidly and then drops rapidly. As a result, the acceleration of the carriage 41 becomes very large. Thus, it is possible to determine whether or not the carriage 41 has performed the stick-slip operation paying attention to the acceleration of the carriage 41.

The controller 126 periodically acquires movement speeds V1 to V6 of the carriage 41 from the speed calculation section 334 of the carriage motor control unit 128 at a predetermined interval T0. Then, the controller 126 sequentially calculates, as the acceleration, differences between the acquired movement speeds V1 to V6 of the carriage 41. That is, the controller 126 calculates a difference ΔV21 between the movement speed V1 and the movement speed V2 obtained by 'V2−V1', a difference ΔV32 between the movement speed V2 and the movement speed V3 obtained by 'V3−V2', a difference ΔV43 between the movement speed V3 and the movement speed V4 obtained by 'V4−V3', a difference ΔV54 between the movement speed V4 and the movement speed V5 obtained by 'V5−V4', and a difference ΔV65 between the movement speed V5 and the movement speed V6 obtained by 'V6−V5'.

Then, the controller 126 compares the acquired differences ΔV21, ΔV32, ΔV43, ΔV54, and ΔV65 with the predetermined threshold value V0 and checks whether or not the differences ΔV21, ΔV32, ΔV43, ΔV54, and ΔV65 exceed the predetermined threshold value V0. When the differences ΔV21, ΔV32, ΔV43, ΔV54, and ΔV65 exceed the predetermined threshold value V0, the controller 126 determines that the carriage 41 performs the stick-slip operation. On the other hand, when the differences ΔV21, ΔV32, ΔV43, ΔV54, and ΔV65 does not exceed the predetermined threshold value V0, the controller 126 determines that the carriage 41 does not perform the stick-slip operation.

In addition, even though the determination on whether or not the carriage 41 performs the stick-slip operation has been herein made paying attention to the time of acceleration of the carriage 41, the determination on whether or not the carriage 41 has performed the stick-slip operation may be made paying attention to the time of deceleration of the carriage 41, that is, minus acceleration (deceleration).

Furthermore, the determination on whether or not the carriage 41 has performed the stick-slip operation may be made in other ways. For example, if a case in which the acquired difference has exceeded the predetermined threshold value V0 occurs for the predetermined number of times for example, twice), it may be possible to determine that the carriage 41 performs the stick-slip operation.

(4) Determination Based on Time for which a Speed of a Carriage is Equal to or Lower than a Predetermined Allowed Speed Here, the determination on whether or not the carriage 41 has performed the stick-slip operation is made on the basis of time measured by a timer that measures time, for which the movement speed of the carriage 41 is equal to or lower than a predetermined allowed lower-limit value, over a period of time from starting of movement of the carriage 41 to completion of the movement of the carriage 41.

Figure 16A:
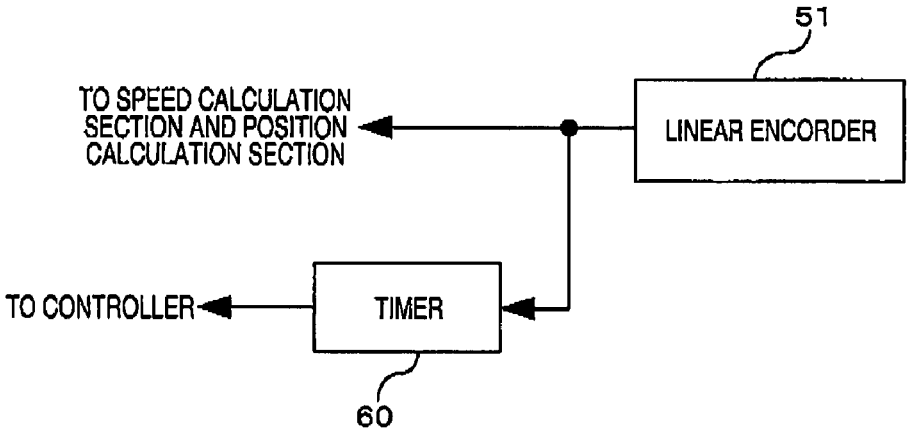
FIG. 16A is a view explaining a carriage motor control unit.

FIG. 16A is a view explaining a timer 60 provided in the carriage motor control unit 128. As shown in FIG. 16A, an output signal, which is output from the linear encoder 51 to the speed calculation section 334 or the position calculation section 331, is input to the timer 60. The timer 60 monitors the output signal of the linear encoder 51 and starts to measure the time when the movement speed of the carriage 41 reaches a predetermined allowed lower-limit value or less. Here, the timer 60 starts the time measurement when a pulse period of the signal output from the linear encoder 51 becomes longer than a predetermined period. When the movement speed of the carriage 41 becomes not equal to or lower than the predetermined allowed lower-limit value, the timer 60 stops the time measurement. Thus, the timer 60 measures the time for which the movement speed of the carriage 41 is equal to or lower than the predetermined allowed lower-limit value. Information on the time measured by the timer 60 is transmitted to the controller 126. The controller 126 determines whether or not the carriage 41 has performed the stick-slip operation on the basis of the information on the measurement time acquired from the timer 60.

Figure 16B:
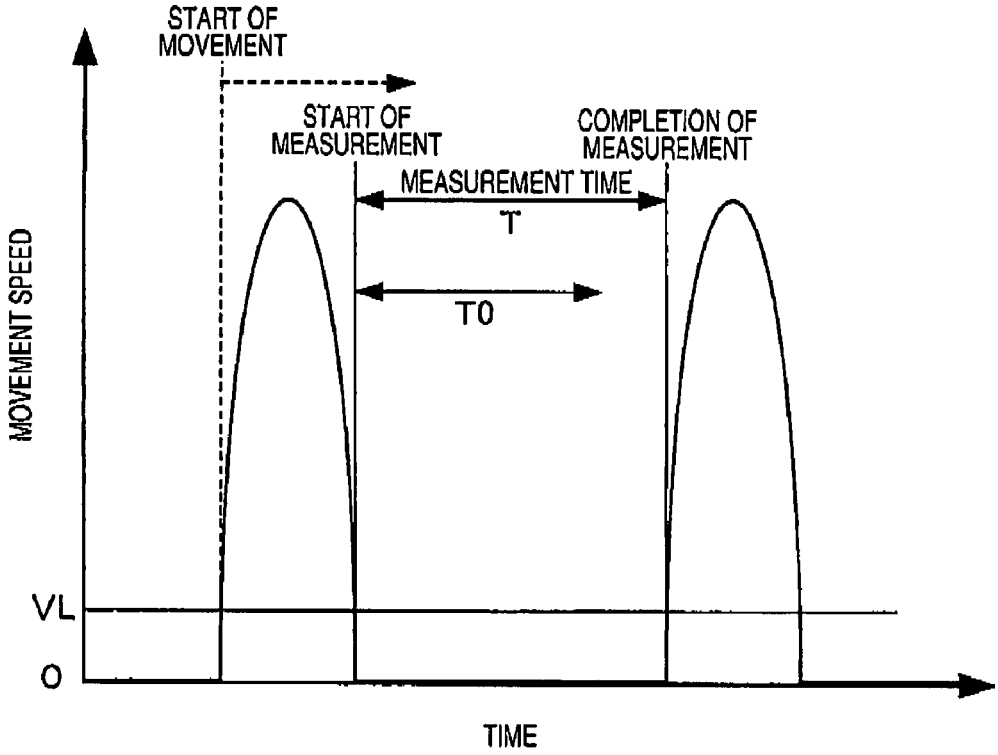
FIG. 16B is an explanatory view illustrating an example of a method of determining a stick-slip operation on the basis of a measurement result of a timer.

FIG. 16B is a view explaining an example of a method of determining whether or not the carriage 41 has performed the stick-slip operation. As shown in FIG. 16B, when the carriage 41 has performed the stick-slip operation, the movement speed of the carriage 41 rises rapidly and then drops rapidly. Then, the carriage 41 starts to move again after a predetermined period of time passes. The carriage 41 repeats such moving operation and stopping operation alternately for the period of time from starting of the movement of the carriage 41 to completion of the movement of the carriage 41.

On the other hand, when the carriage 41 does not perform the stick-slip operation, it is general that such moving operation and stopping operation are not repeated alternately. That is, for a period of time while the carriage 41 starts to move and then completes the movement, the movement speed of the carriage 41 does not drops below the predetermined allowed lower-limit value for a predetermined period of time or more. Thus, by measuring time T, for which the movement speed of the carriage 41 is below a predetermined allowed lower-limit value VL, after the carriage 41 has started to move, it is possible to check whether or not the carriage 41 has performed the stick-slip operation. In addition, the predetermined allowed lower-limit value VL is set as a sufficiently low speed that cannot be assumed as the movement speed of the carriage 41 when the carriage 41 moves without performing stick-slip operation. For example, the predetermined allowed lower-limit value VL may be set to a value close to zero in order to perform the time measurement when the carriage 41 stops.

The timer 60 monitors the output signal of the linear encoder 51. Then, when a pulse period of the output signal from the linear encoder 51 becomes longer than a predetermined period, the timer 60 determines that the movement speed of the carriage 41 is below the predetermined allowed lower Emit value VL, and accordingly, the timer 60 starts the time measurement. The time measurement made by the timer 60 is performed until the movement speed of the carriage 41 is determined to exceed the predetermined allowed lower-limit value VL. Thus, the timer 60 measures the time T for which the movement speed of the carriage 41 is below the predetermined allowed lower-limit value VL. The measurement result of the timer 60 is transmitted to the controller 126 from the timer 60. Here, the measurement time T of the timer 60 may be transmitted from the timer 60 to the controller 126 in real-time manner. Alternatively, the measurement time T of the timer 60 may be transmitted from the timer 60 to the controller 126 after the time measurement of the timer 60 has been completed.

The controller 126 compares the measurement time T, which is transmitted from the timer 60, with the predetermined threshold value T0. Then, when the measurement time T has reached the predetermined threshold value T0, it is determined that the carriage 41 performs the stick-slip operation. On the other hand, when the measurement time T does not reach the predetermined threshold value T0, it is determined that the carriage 41 does not perform the stick-slip operation.

Furthermore, the determination on whether or not the carriage 41 has performed the stick-slip operation may be made in other ways. For example, it may be possible to count the number of times in which the measurement time T has reached the predetermined threshold value V0 and then determine that the carriage 41 performs the stick-slip operation if the counted number of times is a predetermined number of times or more (for example, twice).

Moreover, as methods of determining whether or not the carriage 41 has performed the stick-slip operation, methods other than the above-described methods (1) to (4) may also be used.

Embodiments

First Embodiment

At the time of movement of the carriage 41, it may be necessary to control the carriage 41 to move at a low target speed. However, in the case in which the stick-slip operation occurs, it may be desirable to control the movement of the carriage 41 by setting a high target speed. For example, in the case of moving the carriage 41 at the low target speed, the target speed is too low and a small duty signal is not generated. In addition, due to occurrence of the stick-slip operation that occurs due to solidification of grease, for example, there may be a case in which the carriage 41 does not easily move, and in the worst case, the carriage 41 may stop.

In this case, by raising the target speed to increase a duty signal value that is generated, it is possible to avoid the stick-slip operation in an emergency, even though the stop position precision at the target stopping position of the carriage 41 may be lowered. In the printer 1 according to a first embodiment, the target speed is set to be low in a region where the stick-slip operation does not occur and the target speed is changed to a high speed as a solution in an emergency in a region where the stick-slip operation occurs, thereby suppressing the stick-slip operation from occurring. Here, the occurrence of the movement of the stick-slip operation is suppressed such that the carriage 41 can stop at the stop position within an allowable range.

In order to make such control, in the inkjet printer 1 according to the first embodiment, a region on the guide rail 46 is virtually divided into eight regions. Then, the carriage 41 moves at a constant speed, which is lower than a predetermined speed, in the forward direction and backward direction and a stick-slip operation bit is set according to a detection result of the stick-slip operation in the movement directions of each of the regions. Then, when a stick-slip operation bit 29 of a predetermined region in a predetermined movement direction is set as '1', data used to output the target speed is changed to data for outputting a higher target speed, thereby controlling the movement of the carriage 41.

Figures 17A, 17B:
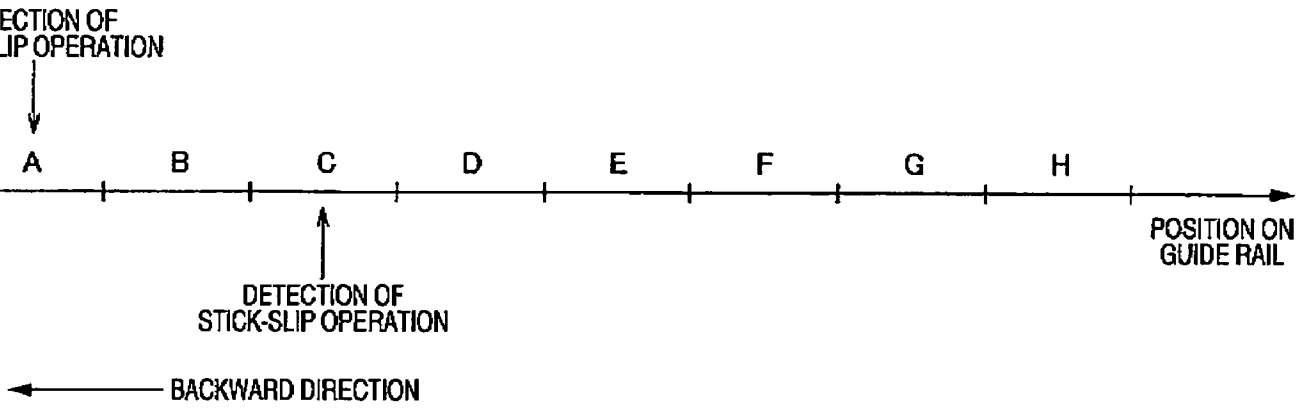
FIG. 17A is a view illustrating an example in which a region on a guide rail 46 is divided into eight regions.
FIG. 17B is a view illustrating an example of stick-slip region byte data stored in a main memory.

FIG. 17A illustrates an example in which a region on the guide rail 46 is divided into eight regions. Here, the region is virtually divided into eight regions having the same width. In addition, regions A to H are assigned sequentially from a starting point in the forward direction.

At the time of an initial operation, the carriage 41 moves at the constant speed, which is lower than a predetermined speed, in the forward direction from the starting point. At this time, the stick-slip operation is detected by using one of the above-described methods of determining the stick-slip operation. For example, the determination on whether or not the carriage 41 has performed the stick-slip operation is made on the basis of the movement speed of the carriage 41. If the stick-slip operation is detected even once, a region where the detect position exists is assumed as a stick-slip region. Referring to FIG. 17A, the stick-slip operation is detected in the region C while the carriage 41 is moving in the forward movement. Therefore, the region C is assumed as a stick-slip region. Moreover, determination on the position is made on the basis of a count value obtained by the linear encoder 51 and the controller 126.

FIG. 17B is a view illustrating an example of stick-slip region byte data stored in the main memory 127. Two kinds of stick-slip region byte data for forward and backward movements are prepared Each stick-slip region byte data includes eight stick-slip operation bits ranging from the region A to the region H. Therefore, in the stick-slip region byte data, it is recorded whether or not each of the regions A to H at the time of movement in a predetermined direction is a stick-slip region. Here, '1' is recorded as a stick-slip operation bit of a region corresponding to the stick-slip region, and '0' is recorded as stick-slip operation bits corresponding to the other regions. Referring to FIG. 17A, since the region C in the forward direction is assumed as the stick-slip region, '1' is recorded as a stick-slip operation bit of the region C in the forward direction and '0' is recorded as stick-slip operation bits of the other regions.

In the same method as described above, values are also set as stick-slip region byte data for the backward case. Referring to FIG. 17A, in the case of the backward movement, the stick-slip operation is detected in the region A. Accordingly, '1' is set as a stick-slip operation bit, which corresponds to the region A, of stick-slip region byte data for the backward case in FIG. 17B. Referring to FIG. 17B, the stick-slip region byte data for the forward movement is different from the stick-slip region byte data for the backward movement. This is because positions at which the stick-slip operations are detected are different in the forward and backward movements.

Change of a Target Speed

Figure 18A:
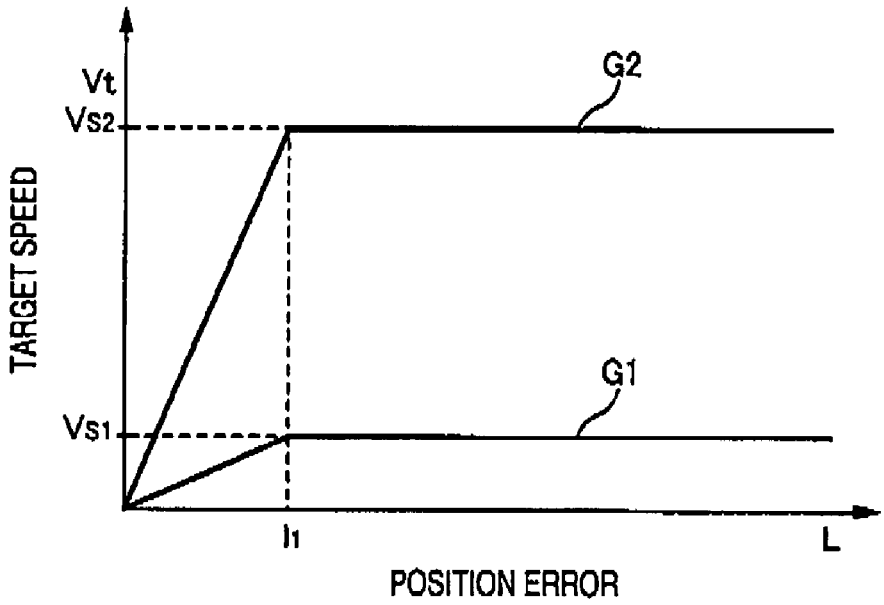
FIG. 18A is a view illustrating a target speed corresponding to a position error between target position and current position of a carriage 41.

FIG. 18A is a view illustrating a target speed corresponding to a position error between target position and current position of the carriage 41. Here, target speed data G1 and target speed data G2 are prepared, as data for calculating a target speed, in the converter 333. Target speed data is data in which a target speed is determined corresponding to the position error. In addition, a target speed corresponding to the position error in the target speed data G2 is set to be larger than a target speed corresponding to the same position error in the target speed data G1. The target speeds are set to increase proportionally until the position error increases from 0 to l1 and to be constant when the position error is larger than 'l1'.

The target speed (maximum speed) of the target speed data G1 after 'l1' is set to Vs1. Specifically, the target speed of the target speed data G1 after 'l1' is set to 0.0127 (m/s). In addition, a maximum speed of the target speed data G2 is set to Vs2. Specifically, the target speed of the target speed data G2 is set to 0.102 (m/s). In addition, a maximum speed when the carriage 41 moves at the constant speed while ejecting ink drops is 0.508 (m/s).

Figure 18B:
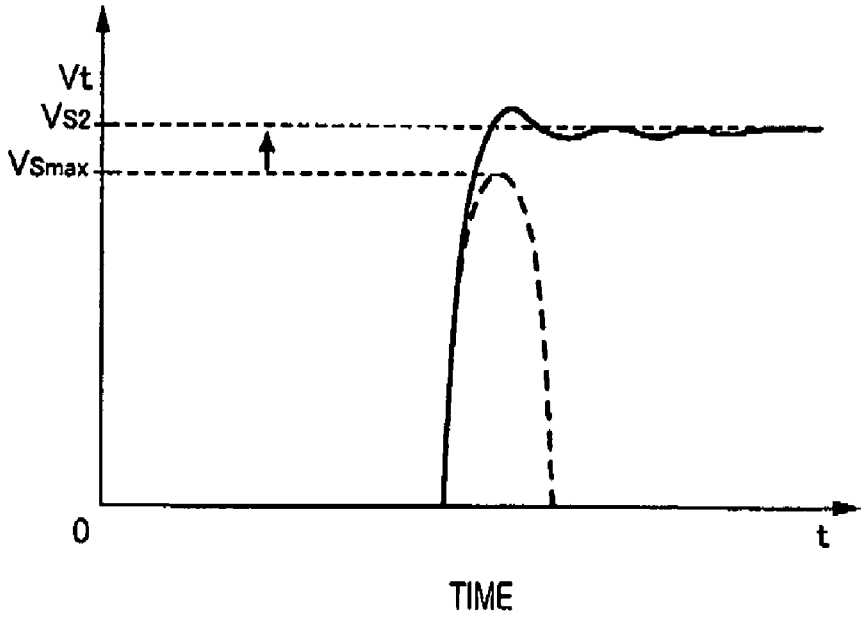
FIG. 18B is a view illustrating the relationship between a target maximum speed Vs2 of target speed data G2 and a maximum speed of the carriage 41 at the time of a stick-slip operation.

FIG. 18B is a view explaining the relationship between the maximum speed of the carriage 41 and the target maximum-speed Vs2 of the target speed data G2 at the time of a stick-slip operation. In FIG. 18B, a dotted line indicates the speed change of the carriage 41 at the time of the stick-slip operation. Moreover, a solid line indicates the speed change of the carriage 41 when a target speed reaches Vs2.

At the time of the stick-slip operation, the carriage 41 moves while periodically raising and dropping the speed thereof to the maximum speed Vstmax. The target speed Vs2 of the target speed data G2 is set to a value larger than the maximum speed Vstmax of the carriage 41 at the time of the stick-slip operation. Thus, when the carriage 41 moves at the target speed Vs2, the movement speed of the carriage 41 rises rapidly due to the stick-slip operation. However, since the target speed is set to the high speed Vs2, a control of quickly decreasing the movement speed is not performed but the movement speed converges on the target speed Vs2. As a result, it is possible to suppress the stick-slip operation from occurring.

As described above, the target speed Vs2 in the target speed data G2 is set to be higher than the maximum speed Vstmax when the stick-slip operation occurs, even though the target speed Vs2 in the target speed data G2 is set to increase up to a speed when ink is ejected. In addition, the stopping precision at the target position of the carriage 41 is set to be as low as possible while causing the stick-slip operation not to easily occur.

When moving the carriage 41 at a speed equal to or lower than a predetermined speed at the time of printing, the carriage motor 42 is controlled on the basis of stick-slip region byte data corresponding to movement directions that is stored in the main memory 127. Specifically, when the carriage 41 moves at the speed equal to or lower than the predetermined speed, the controller 126 reads stick-slip region byte data on the corresponding movement direction from the main memory 127. Further, if the controller 126 determines that the carriage 41 is located in the stick-slip region referring to the data, the controller 126 causes the converter 333 to output a target speed by using the target speed data G1. On the other hand, when the carriage 41 is located in the stick-slip region, the controller 126 causes the converter 333 to output a target speed by using the target speed data G2. In addition, switching between the target speed data G1 and G2 that is referred is performed when a switching instruction is made from the controller 126 to the carriage motor control unit 128.

For example, a case is considered in which the position of the carriage 41 is apart from the target position such that the position error is larger than '11'. In this case, if the carriage 41 is not positioned in the stick-slip region, the converter 333 outputs 'Vs1' to the subtractor 335 as the target speed by referring to the target speed data G1. Accordingly, the carriage 41 is controlled to move at the speed Vs1.

Thereafter, when the carriage 41 moves to enter the stick-slip region (in this case, the position error is still larger than '11'), the target speed data that the converter 333 refers to switches to 'G2' by an instruction of the controller 126. Then, the converter 333 outputs 'Vs2' to the subtractor 335 as a target speed by referring to the target speed data G2. Accordingly, the carriage 41 is controlled to move at the speed Vs2.

Thus, when the carriage 41 is positioned at a stick-slip region, it is possible to suppress the stick-slip operation from occurring by setting the target speed with reference to the target speed data G2 such that a higher target speed is output. In addition, the target speed Vs2 may be set to a value lower than the maximum speed Vstmax of the carriage 41 at the time of the stick-slip operation, as long as the value corresponds to a target speed at which the occurrence of the stick-slip operation can be suppressed.

In addition, even though the guide rail 46 is virtually divided into eight regions, the guide rail 46 may also be divided into regions more than the eight regions.

Figure 19:
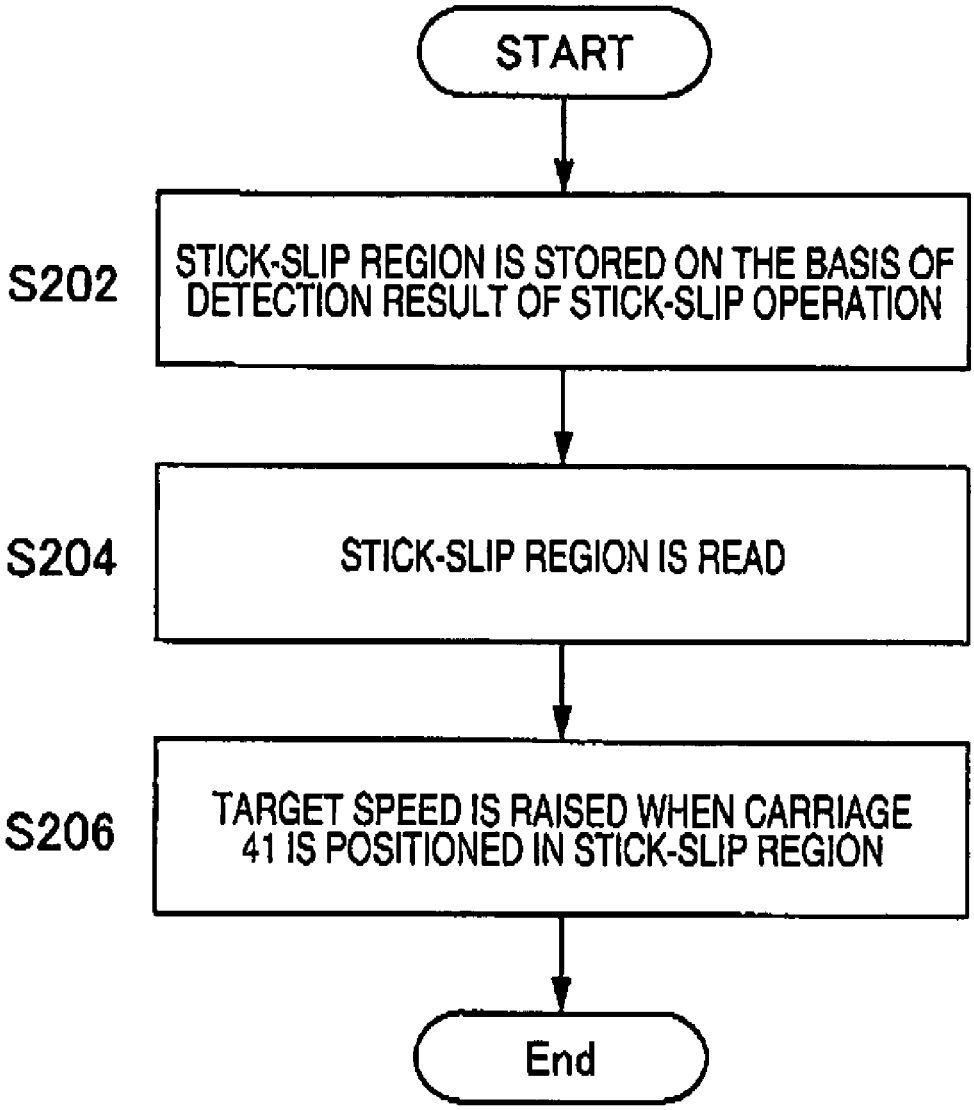
FIG. 19 is a flow chart explaining an example of response processing of a controller 126.

FIG. 19 is a flow chart explaining an example of response processing of the controller 126. At the time of an initial operation when power is supplied, the carriage 41 moves at a constant speed equal to or lower than a predetermined speed and the controller 126 detects a stick-slip operation. Then, the controller 126 stores a stick-slip region in the main memory 127 on the basis of the detected result (S202).

Then, before performing normal printing processing, the controller 126 reads the stored stick-slip region from the main memory 127 (S204).

Then, when the carriage 41 moves at the constant speed equal to or lower than the predetermined speed during normal printing processing, if the carriage 41 is positioned in the stick-slip region, the target speed is raised to control the carriage motor 42 (S206).

Thus, since the target speed is raised to control the carriage motor 42 when the carriage 41 is positioned in the stick-slip region, it is possible to suppress the stick-slip operation from occurring.

Second Embodiment

It the inkjet printer 1 according to a second embodiment, the carriage 41 moves at a constant speed equal to or lower than a predetermined speed in forward and backward directions when power is supplied to the inkjet printer 1, such that a position at which the stick-slip operation has been detected is pinpointed. Then, a predetermined range having a position, at which the stick-slip operation has been detected, as a center is stored as a stick-slip region for each movement direction in the main memory 127. In addition, when the carriage 41 is controlled to move at a low speed at the time of an actual printing operation, if the carriage 41 is positioned in the stick-slip region in each movement direction, the movement of the carriage 41 is controlled by changing data (target speed data G1), which is used to output the target speed, to data (target speed data G2) used to output a higher target speed.

Further, in the first embodiment, the predetermined regions were specified by virtually dividing the guide rail 46 beforehand. Furthermore, the stick-slip region was set with respect to the specified regions. The second embodiment is different from the first embodiment in that a predetermined region is not determined beforehand but a predetermined range is set as a stick-slip region with a position, at which the stick-slip operation has been detected, as a center. Hereinafter, the operation will be described.

Figure 20:
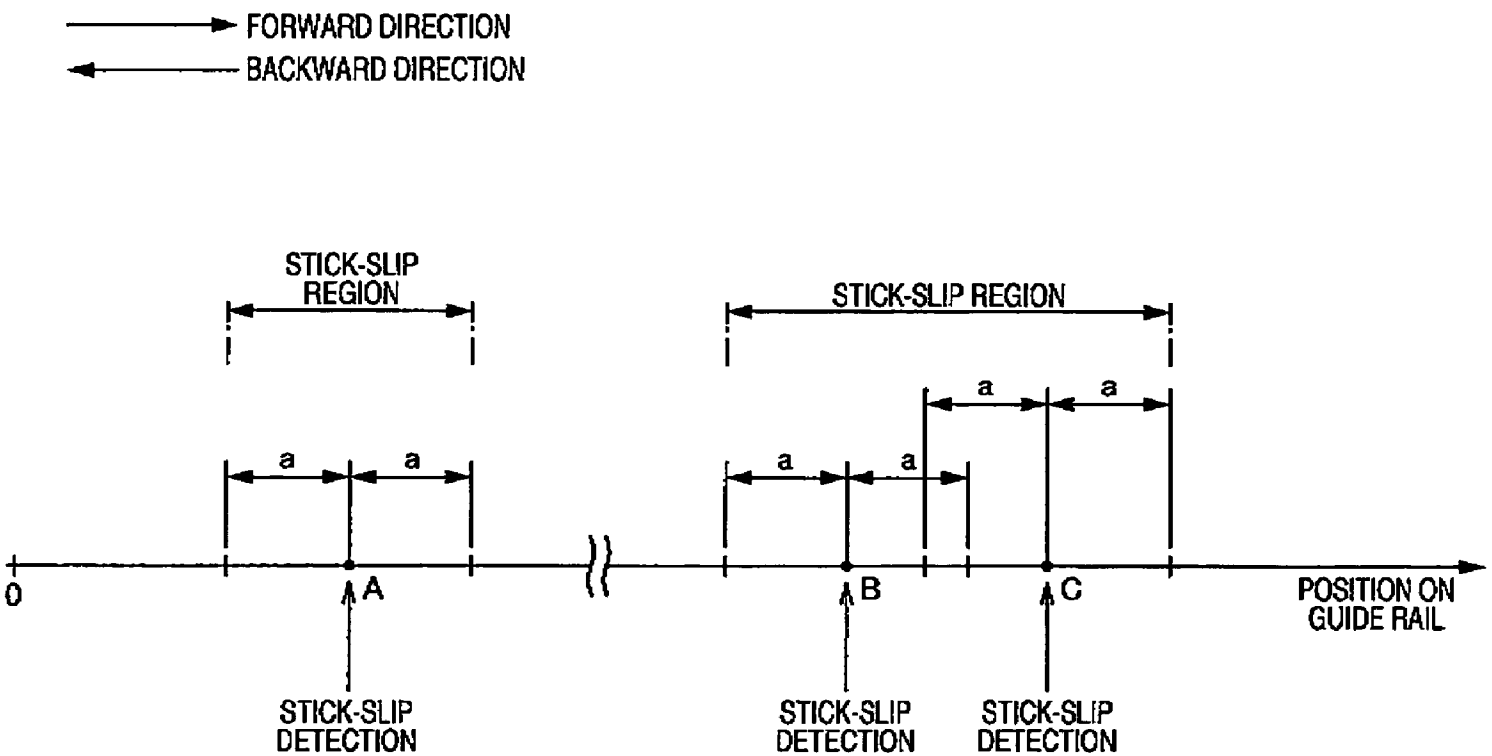
FIG. 20 is a view illustrating the relationship between a stick-slip region and a position at which a stick-slip operation is detected.

FIG. 20 is a view illustrating the relationship between a stick-slip region and a position at which a stick-slip operation is detected. In FIG. 20, it is assumed that a leftmost end (refer to FIG. 2) in the movement direction of a carriage is a starting point of a forward path. Moreover, in the present embodiment, a count value of the starting point is set to 0 and the counting value increases as the carriage 41 moves along the forward direction (carriage movement direction to the right in FIG. 2).

The linear encoder 51 mounted in the inkjet printer 1 can pinpoint the position of the carriage 41 with the resolution of 720 dpi. In addition, whenever the carriage 41 moves by 720 dpi in the forward direction when the count value of the starting point is '0', the count value is incremented. For example, a count value '100' means that the carriage 41 has moved by 100/720 from the starting point.

When power is supplied, an operation of storing a stick-slip region is performed as one of the initial operation. There are two kinds of operations of storing the stick-slip region in forward and backward directions. Since movement directions of the carriage 41 are different in the operations of storing the stick-slip region in the forward and backward directions, the operation of storing the stick-slip region in the forward direction will now be described.

First, the carriage 41 moves at a constant speed, which is equal to or lower than a predetermined speed, in the forward direction from the starting point (count value of '0'). At this time, a stick-slip operation is detected by using one of the above-described methods of determining the stick-slip operation. For example, it is determined whether or not the carriage 41 performs the stick-slip operation on the basis of the movement speed of the carriage 41. Then, if the stick-slip operation is detected, a predetermined range is set as a stick-slip region with the detected position as a center.

For example, referring to FIG. 20, the stick-slip operation is detected at a position A. Then, the controller 126 determines a range 'a' around the position A to be a stick-slip region. For example, assuming that the range 'a' corresponds to 100 counts and a count value of the position A is 300, a count value in a stick-slip region is in a range of 200 to 400.

Then, a stick-slip region is set on the basis of the above result. Here, a starting point count value of the stick-slip region and an ending point count value of the stick-slip region are stored in the main memory 127. For example, as described above, if the stick-slip operation is detected at the position at which a count value is 300, a range where count values are 200 to 400 is stored as the stick-slip region in the main memory 127.

FIG. 21A is a view illustrating starting point count value and ending point count value of a stick-slip region stored in the main memory 127. For example, in FIG. 21A, the starting point count value of a stick-slip region is stored as 200 and a the ending point count value of the stick-slip region is stored as 400, and thus a range corresponding to count values 200 to 400 is considered as the stick-slip region.

FIG. 21B is an example of processing in a case when stick-slip regions overlap. Referring back to FIG. 20A, the stick-slip operation is detected at positions B and C. Assuming that a count value of the position B is 1700 and a count value of the position C is 1800, a stick-slip region corresponding to the position B ranges from 1600 to 1800 and a stick-slip region corresponding to the position C ranges from 1700 to 1900. In this case, the stick-slip regions overlap in the range of 1700 to 1800. In this case, as shown in a right side of FIG. 21B, a range of 1600 to 1900 is stored as a stick-slip region.

Processing when stick-slip regions overlap is performed as follows, for example. At the beginning, 1600 is recorded as a starting point count value and 1800 is recorded as an ending point count value of a stick-slip region corresponding to the position B. Then, 1700 is recorded as a starting point count value and 1900 is recorded as an ending point count value of a stick-slip region corresponding to the position C. Then, it is determined whether or not the starting point count value 1700 is positioned within the previous stick-slip region 1600 to 1800. In this case, since the starting point count value 1700 is positioned within the previous stick-slip region, the ending point count value 1900 of the subsequent stick-slip region is recorded as the previous ending point count value and data (starting point count value 1700 and ending point count value 1900) of the next stick-slip region is deleted. Thus, when stick-slip regions overlap, the stick-slip regions are combined.

FIG. 22A is a view illustrating starting point count value and ending point-count value of a stick-slip region in the forward direction. FIG. 22B is a view illustrating starting point count value and ending point count value of a stick-slip region in the backward direction. Thus, at the time of an initial operation when power is supplied, the carriage 41 moves at a predetermined constant speed so as to detect a stick-slip operation, and then a stick-slip region in the forward direction is stored on the basis of the detection result. Moreover, in the substantially same method as described above, a stick-slip region in the backward direction is stored. Referring to FIG. 22A and FIG. 22B, starting point count value and ending point count value of a stick-slip region in the forward direction are different from starting point count value and ending point count value of a stick-slip region in the backward direction. This is because positions at which stick-slip operations are detected are different in the forward and backward movements.

Then, in cases other than the initial operation, when the carriage 41 moves at the constant speed, which is equal to or lower than a predetermined speed, in the forward direction, the carriage motor 42 is controlled on the basis of the stored stick-slip region in the forward direction. Specifically, when the carriage 41 moves at the constant speed, which is equal to or lower than the predetermined speed, in the forward direction, the controller 126 reads the stored starting point count value and ending point count value of the stick-slip region in the forward direction from the main memory 127. Then, when the carriage 41 is positioned in the stick-slip region, the target speed data that the converter 333 refers to switches from G1 to G2 shown in FIG. 18A, in the same manner as in the 'Change of target speed' in the first embodiment, thereby controlling the carriage motor 42.

Moreover, in cases other than the initial operation, when the carriage 41 moves at the constant speed, which is equal to or lower than a predetermined speed, in the backward direction, the carriage motor 42 is controlled on the basis of the stored stick-slip region in the backward direction. Specifically, when the carriage 41 moves at the constant speed, which is equal to or lower than the predetermined speed, in the backward direction, the controller 126 reads the stored starting point count value and ending point count value of the stick-slip region in the backward direction from the main memory 127. Then, when the carriage 41 is positioned in the stick-slip region, the target speed data that the converter 333 refers to switches from G1 to G2 shown in FIG. 18A, in the same manner as in the 'Change of target speed' in the fist embodiment, thereby controlling the carriage motor 42.

As described above, since the stick-slip region is stored on the basis of the position at which the stick-slip operation is detected and the movement of the carriage 41 is controlled such that the target speed becomes faster in the stick-slip region, it is possible to suppress the stick-slip operation from occurring.

Third Embodiment

In the inkjet printer 1 according to a third embodiment, it is detected whether or not a stick-slip operation has occurred while moving the carriage 41 at a speed equal to or lower than a predetermined speed. Then, if the stick-slip operation is detected, the controller 126 switches the target speed data, which is referred by the converter 333, from G1 to G2 shown in FIG. 18A to thereby control the carriage motor 42, in the same manner as in the embodiments described above.

Figure 23:
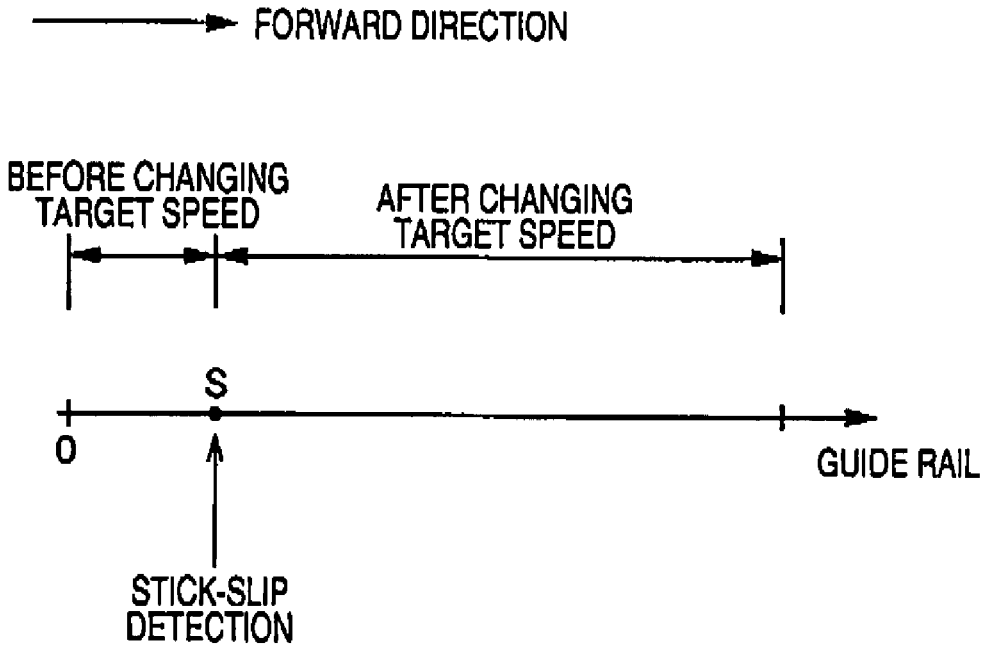
FIG. 23 is a view illustrating the relationship between a target speed and a position at which a stick-slip operation is detected in a third embodiment.

FIG. 23 is a view illustrating the relationship between a target speed and a position at which a stick-slip operation is detected in a third embodiment. Here, a case is considered in which the carriage 41 moves in the forward direction. At the time of a printing operation, the carriage 41 moves at the constant speed equal to or lower than a predetermined speed. At this time, a stick-slip operation is detected by Using one of the above-described methods of determining the stick-slip operation. For example, it is determined whether or not the carriage 41 performs the stick-slip operation on the basis of the movement speed of the carriage 41. Then, if the stick-slip operation is detected at a position S in FIG. 23, the controller 126 switches the target speed data, which is referred by the converter 333, from G1 to G2 while the carriage 41 is moving from the detected position to a target stopping position in the forward direction. Then, the converter 333 outputs a target speed faster than that output with reference to the target speed data G1 to the subtractor 335 to thereby control the carriage motor 42.

Even when the carriage 41 moves at the constant speed, which is equal to or lower than the predetermined speed, in the backward direction, the same control as in the case of the forward direction is performed. That is, if a stick-slip operation is detected while the carriage 41 is moving in the backward direction, the controller 126 switches the target speed data, which is referred by the converter 333, from G1 to G2 while the carriage 41 is moving from the detected position to a target stopping position in the backward direction. Then, the converter 333 outputs a target speed faster than that output with reference to the target speed data G1 to the subtractor 335 to thereby control the carriage motor 42.

In this manner, when the stick-slip operation occurs, the carriage motor 42 is controlled to move at the faster target speed, it is possible to suppress a subsequent stick-slip operation from occurring.

Other Target Speed Controls

Figure 24:
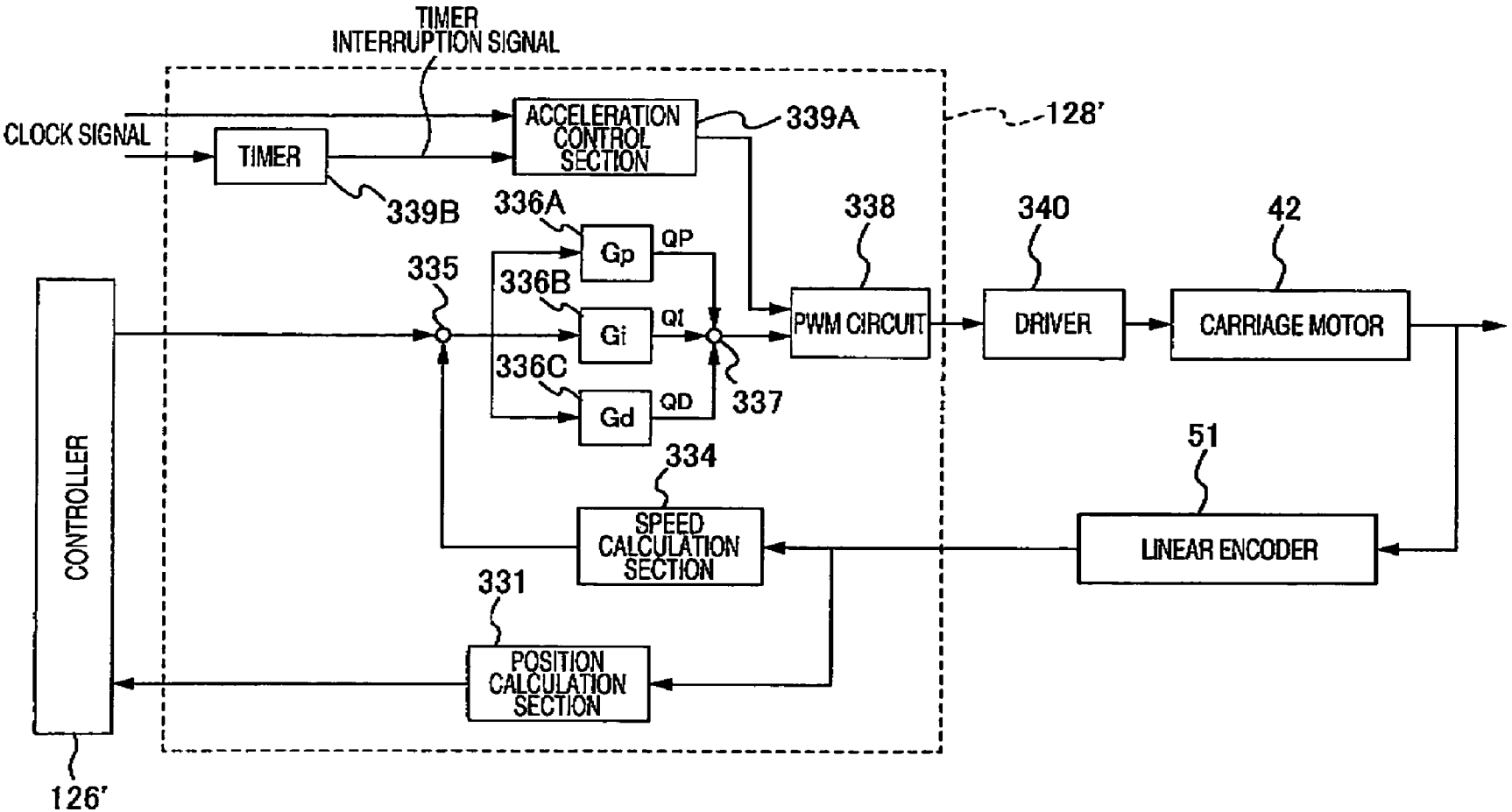
FIG. 24 is a view explaining another type of controller 126' and carriage motor control unit 128'.

FIG. 24 is a view explaining another type of controller 126' and carriage motor control unit 128'. The controller 126' shown in FIG. 24 has an additional function of outputting a target speed corresponding to the position of the carriage 41, as compared with the above-mentioned controller 126. In addition, the configuration of the carriage motor control unit 128' shown in FIG. 24 is similar to the configuration of the carriage motor 128 shown in FIG. 9A. Therefore, the same components are denoted by the same reference numerals, and detailed explanation thereof will not be made but different parts will be described below.

Referring to FIG. 24, an output of the position calculation section 331 of the carriage motor control unit 128 is connected to the controller 126'. In addition, an output of the controller 126' is connected to the subtractor 335. In addition, the subtractor 332 and the converter 333 are not provided.

Figure 25:
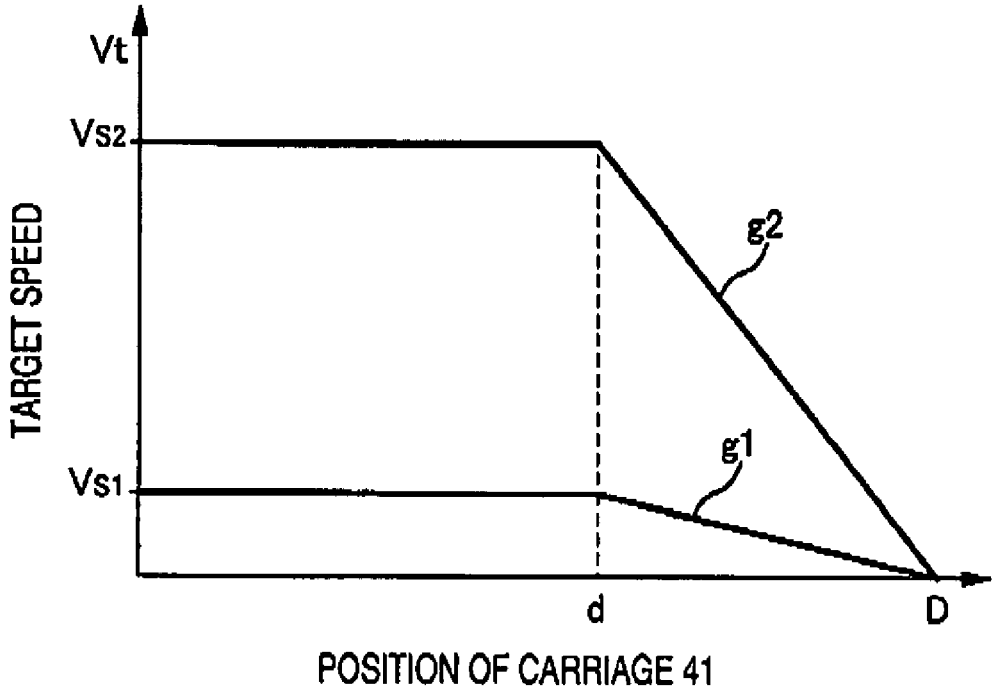
FIG. 25 is a view illustrating a target speed corresponding to the position of the carriage 41.

FIG. 25 is a view illustrating a target speed corresponding to the position of the carriage 41. Here, target speed data g1 and g2 are prepared as data used to obtain a target speed. The target speed data is data in which a target speed is determined corresponding to the position of the carriage 41. In addition, a target speed corresponding to the position of the carriage 41 in the target speed data g2 is set to be larger than a target speed corresponding to the same position of the carriage 41 in the target speed data g1.

The target stopping position of the carriage 41 is set as D. Further, while the carriage 41 is positioned from a position 0 to a position d, a fixed value is output as the target speed. Then, the target speed decreases proportionally over a range of the position d to the target position D.

The controller 126' acquires the detection position of the carriage 41 from the position calculation section 331. When the detection position is acquired, the controller 126' outputs a target speed corresponding to the position of the carriage 41 to the subtractor 335 with reference to the target speed data g1 shown in FIG. 25. For example, when the carriage 41 is positioned within a range of 0 to d, the controller 126' outputs Vs1 to the subtractor 335 as a target speed.

In the case of using the controller 126' and the carriage motor control unit 128' in the first and second embodiments, when the carriage 41 enters the stick-slip region, the target speed data referred by the controller 126' switches from g1 to g2. For example, when the carriage 41 is positioned within the stick-slip region and the position of the carriage 41 is in a range of 0 to d, Vs2 is output as the target speed to the subtractor 335.

Furthermore, in the case of using the controller 126' and the carriage motor control unit 128' in the third embodiment, when a stick-slip operation of the carriage 41 is detected, the target speed data referred by the controller 126' switches from g1 to g2.

Thus, since the controller 126' has the target speed data g1 and g2, a target speed can be easily switched.

Summary (1) The printing apparatus 1 according to the present embodiment includes: the head 21 that performs printing with respect to the medium S; the carriage motor 42 that is used to move the head 21; the guide rail 46 that guides the head 21 along a predetermined direction; the controller 126 that determines whether or not the head 21 performs a stick-slip operation; and the carriage motor control unit 128 that generates a duty signal value for controlling the carriage motor 42 when moving the head 21. In addition, the carriage motor control unit 128 generates a duty signal value for moving the head 21 at a predetermined target speed on the basis of determination of the controller 126 that the head 21 does not perform the stick-slip operation and generates a duty signal value for moving the head 21 at a target speed faster than the predetermined target speed on the basis of determination of the controller 126 that the head 21 performs the stick-slip operation.

Thus, on the basis of the determination that the stick-slip operation is performed, the head 21 is carried at the target speed faster than that when determining that the stick-slip operation is not performed. As a result, it is possible to suppress the stick-slip operation from occurring.

(2) Further, in the printing apparatus 1, the target speed faster than the predetermined target speed is set on the basis of a distance from the head 21 to a target stopping position of the head 21.

Thus, it is possible to make a speed control corresponding to the distance from the head 21 to the target stopping position of the head 21.

(3) Furthermore, in the printing apparatus 1, the target speed faster than the predetermined target speed is set to a fixed value when the distance from the head 21 to the target stopping position of the head 21 is larger than a predetermined distance.

Thus, when the distance from the head 21 to the target stopping position of the head 21 is larger than the predetermined distance, a maximum speed corresponding to the fixed value can be set as a target speed.

(4) Furthermore, in the printing apparatus 1, the target speed faster than the predetermined target speed is set to a speed higher than the maximum speed Vstmax of the head 21 at the time of the stick-slip operation when the distance from the head 21 to the target stopping position of the head 21 is larger than a predetermined distance.

Thus, since the speed of the head 21 converges on the target speed faster than the predetermined target speed, it is possible to suppress the stick-slip operation from occurring.

(5) In addition, the printing apparatus 1 further includes a storage unit that stores a stick-slip region set on the basis of a position determined by the controller 126 that the head 21 performs the stick-slip operation. In addition, the carriage motor control unit 128 generates a duty signal value for moving the head 21 at the predetermined target speed when the head 21 is not positioned in the stick-slip region and generates a duty signal value for moving the head 21 at the target speed faster than the predetermined target speed when the head 21 is positioned in the stick-slip region.

Thus, since the head 21 is carried at the target speed faster than the predetermined target speed when the head 21 is positioned in the stick-slip region where the head 21 performs the stick-slip operation, it is possible to suppress the stick-slip operation from occurring.

(6) In addition, the main memory 127 stores a predetermined range from the position, which is determined by the controller 126 that the head 21 performs the stick-slip operation, as the stick-slip region.

Thus, the stick-slip region can be easily set.

(7) In addition, the controller 126 performs the determination on whether the stick-slip operation is performed or not when moving the head 21 along the guide rail 46 at a speed equal to or lower than a predetermined speed.

Thus, when moving the head 21 at the speed, which is equal to or lower than the predetermined speed and at which the stick-slip operation occurs easily, it is possible to determine whether or not the stick-slip operation is performed (8) In addition, the printing apparatus 1 further includes a speed detection unit that detects a movement speed of the head 21. In addition, the controller 126 determines whether or not the head 21 performs a stick-slip operation on the basis of the movement speed detected by the speed detection unit.

(9) Furthermore, the controller 126 determines whether or not the head 21 performs a stick-slip operation on the basis of the duty signal value.

(10) In addition, the printing apparatus 1 further includes an acceleration detection unit that detects acceleration of the head 21. Moreover, the controller 126 determines whether or not the head 21 performs a stick-slip operation on the basis of the acceleration detected by the acceleration detection unit.

(11) In addition, the printing apparatus 1 further includes a timer that measures time, for which a movement speed of the head 21 is equal to or lower than a predetermined allowed lower-limit value, over a period of time from starting of movement of the head 21 to completion of the movement of the head 21. Moreover, the controller 126 determines whether or not the head 21 performs a stick-slip operation on the basis of the time measured by the timer.

Through the determination described above, it is possible to easily determine whether or not the head 21 performs the stick-slip operation.

(12) Furthermore, the head 21 has nozzles from which ink is ejected toward the medium S in order to perform printing with respect to the medium S.

(13) Furthermore, a printing apparatus including all of the constituent components described above is most effective to achieve the object of the invention, since almost all of the effects described above can be realized.

(14) Furthermore, there is also provided a method of coping with stick-slip including: generating a duty signal value for controlling the carriage motor 42 used to move the head 21 in order to move the head 21, which performs printing with respect to the medium S, along the guide rail 46 that guides the head 21 along a predetermined direction; determining whether or not the head 21 performs a stick-slip operation; and generating a duty signal value for moving the head 21 at a predetermined target speed on the basis of the determination that the head 21 does not perform the stick-slip operation and generating a duty signal value for moving the head 21 at a target speed faster than the predetermined target speed on the basis of the determination that the head 21 performs the stick-slip operation.

(15) Furthermore, there is also provided a program for executing the method of coping with stick-slip. That is, the program causes a computer to execute: generating a duty signal value for controlling the carriage motor 42 used to move the head 21 in order to move the head 21, which performs printing with respect to the medium S, along the guide rail 46 that guides the head 21 along a predetermined direction; determining whether or not the head 21 performs a stick-slip operation; and generating a duty signal value for moving the head 21 at a predetermined target speed on the basis of the determination that the head 21 does not perform the stick-slip operation and generating a duty signal value for moving the head 21 at a target speed faster than the predetermined target speed on the basis of the determination that the head 21 performs the stick-slip operation.

(16) In addition, there is also provided a printing system in which the above-described printing apparatus is connected to a computer that is connectable to the printing apparatus.

Configuration of a Printing System or the Like

Figure 26:
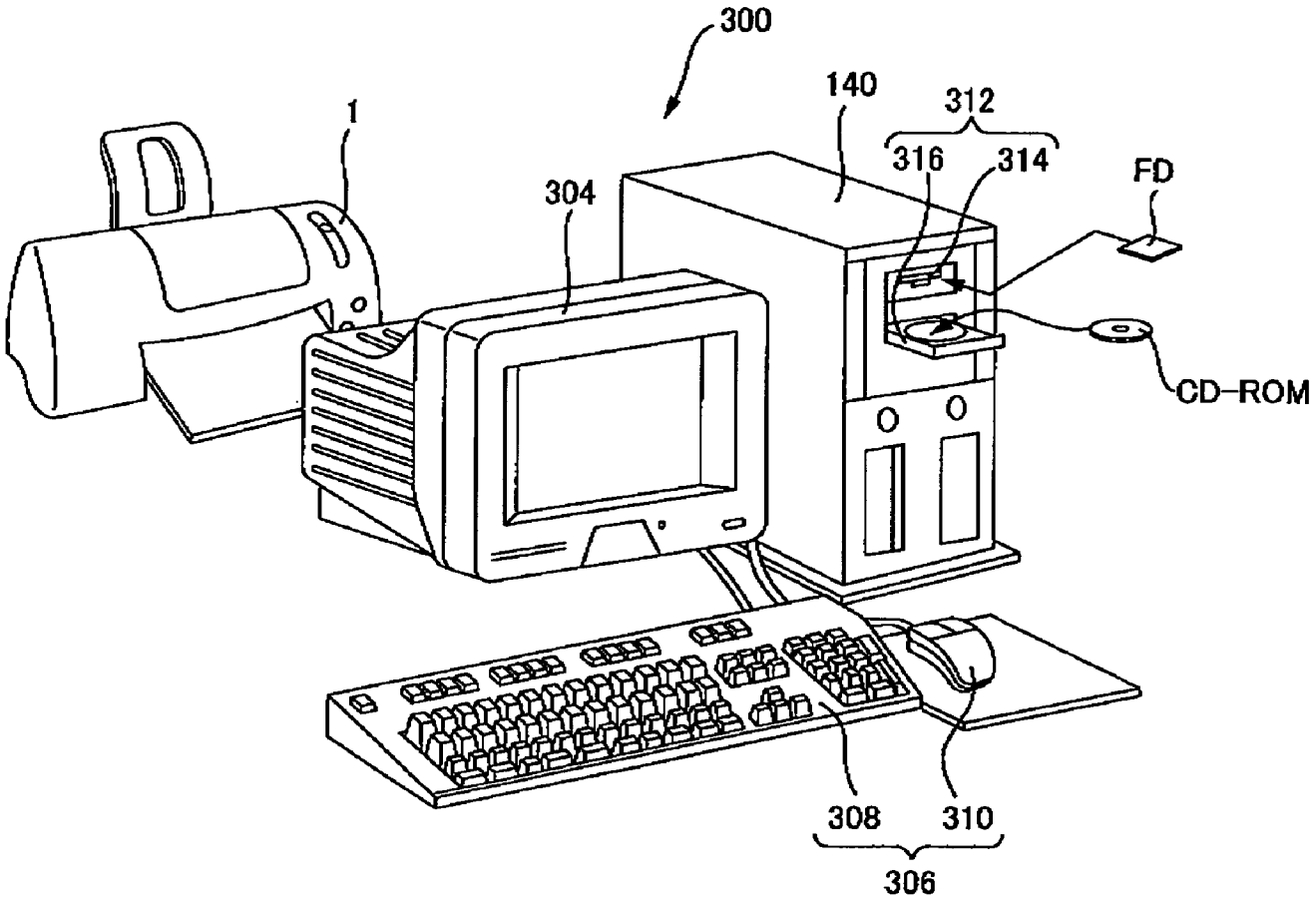
FIG. 26 is a view illustrating the configuration of outer appearance of a printing system according to an embodiment of the invention.

Next, a printing system including the inkjet printer 1 as a printing apparatus will be described as an example of a printing system according to an embodiment of the invention. FIG. 26 illustrates the configuration of outer appearance of a printing system according to an embodiment of the invention. A printing system 300 includes a computer 140, a display device 304, and an input device 306. The computer 140 is realized by using various kinds of computers including a personal computer or the like.

The computer 140 includes readers 312, such as a FD drive 314 and a CD-ROM drive 316. Further, the computer 140 may include a MO (magnet optical) disk drive, a DVD drive, and the like. In addition, the display device 304 is realized by using various kinds of display devices, such as a CRT display, a plasma display, and a liquid crystal display. The input device 306 is realized by using a keyboard 308, a mouse 310, and the like.

Figure 27:
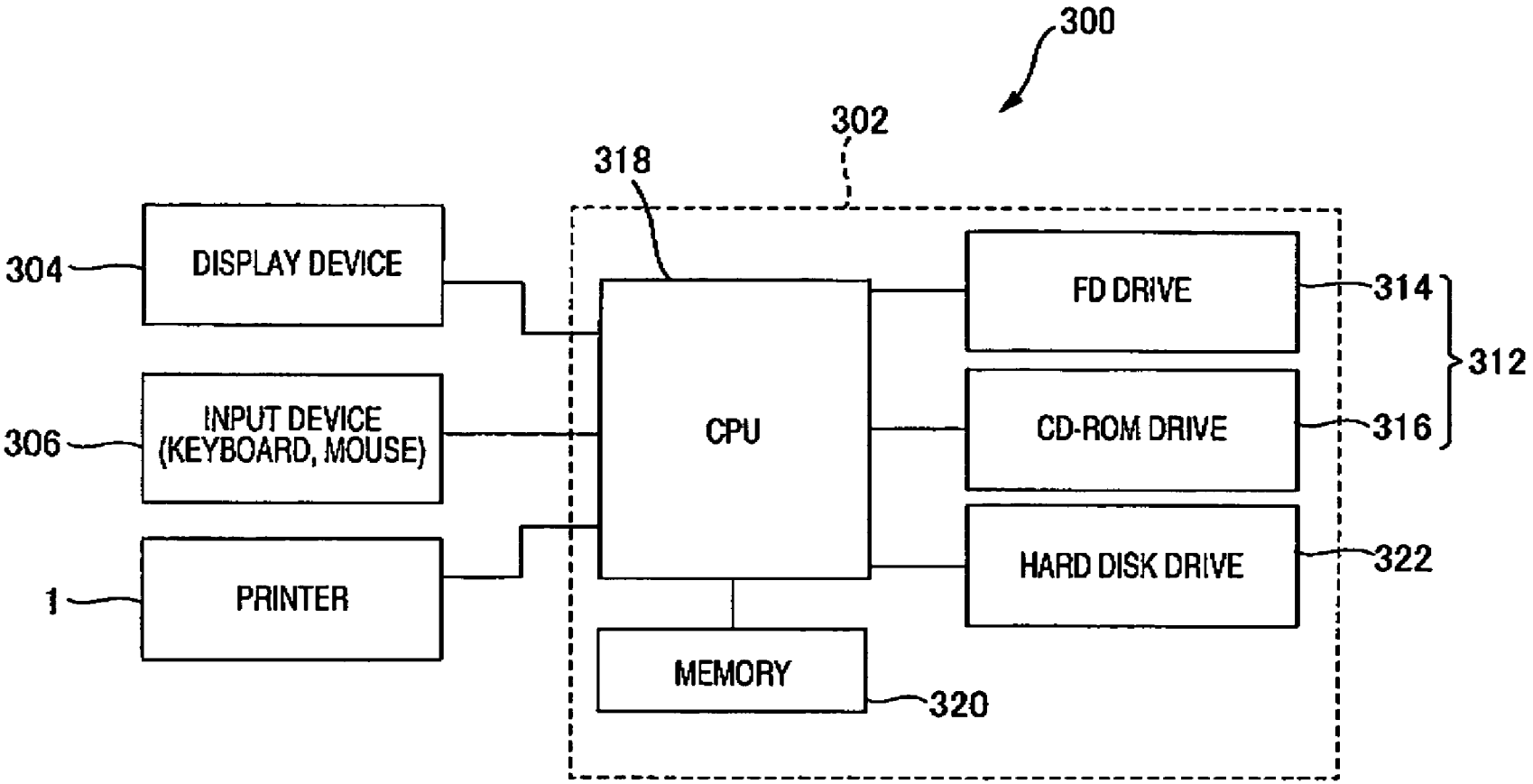
FIG. 27 is a block diagram illustrating an example of the system configuration of a printing system according to an embodiment.

FIG. 27 is a block diagram illustrating an example of the system configuration of the printing system according to the present embodiment. The computer 140 includes a CPU 318, a memory 320, and a hard disk drive 322 in addition to the readers 312, such as the FD drive 314 and the CD-ROM drive 316.

The CPU 318 makes an overall control on the computer 140. In addition, various kinds of data are stored in the memory 320. A printer driver or the like is installed in the hard disk drive 322 as a program for controlling a printing apparatus such as the inkjet printer 1 according to the present embodiment. The CPU 318 reads the program, such as the printer driver, stored in the hard disk drive 322 and operates according to the program. Moreover, the CPU 318 is connected with the display device 304, the input device 306, the inkjet printer 1, and the like provided outside the computer 140.

The printing system 300 realized as described above is superior to a system in the related art.

Other Embodiments

While the invention has been described with reference to the printing apparatus, such as the printer according to the above embodiments, it should be understood that the above embodiments are for illustrative purposes and are not intended to limit the invention. That is, various modifications and changes may be made without departing from the spirit and scope of the invention, and it cannot be overemphasized that the equivalents are included in the invention. In particular, those described below are also applied in the printing apparatus according to the embodiments of the invention.

Printing Head

In the embodiments described above, the print head (head 21) has the nozzles #1 to #180 from which ink is ejected and printing is performed by causing ink to be ejected from the nozzles #1 to #180. However, a print head referred herein is not necessarily limited to the head 21. That is, any kind of print head may be used as long as printing on a medium can be performed.

Motor

In the embodiments described above, as a motor, there has been used the carriage motor 42 that causes the carriage 41 to move through the pulley 44 and the timing belt 45. However, any kind of motor may be used as long as it is a motor that causes the 'print head' to move. That is, any kind of motor may be used as long as it is a motor that causes a print head, which performs printing on a medium, to move.

Guide Unit

In the embodiments described above, the guide rail 46 that guides the print head (head 21 and carriage 41) linearly along the horizontal direction has been described as a 'guide unit' that guides the print head (head 21 and carriage 41) along a predetermined direction. However, the guide unit is not necessarily limited to the guide rail 46. That is, any kind of guide unit may be used as long as the guide unit guides the print head (head 21 and carriage 41) along the horizontal direction.

Motor Control Unit

In the embodiments described above, as an example of a 'motor control unit', the carriage motor control unit 128 that performs the PID control with respect to a motor (carriage motor 42) has been described. However, a motor control unit referred herein is not necessarily limited to the carriage motor control unit 128. That is, as long as the motor control unit serves as a control unit that controls a motor, any kind of control method may be adopted to control the motor. For example, it is possible to use a motor control unit that controls a motor by using a method other than the PID control.

Printing Apparatus

In the embodiments described above, the inkjet printer 1 has been exemplified as a printing apparatus. However, the invention is not limited to the printing apparatus. For example, it may be possible to use an inkjet printer that ejects ink in other methods.

Further, in addition to the inkjet printer 1, any type of printing apparatus may be used as long as the printing apparatus includes a print head that performs printing with respect to a medium and is provided to be able to move along the predetermined direction.

Ink

As for ink used, various kinds of ink including pigment ink and dye ink may be used.

As for colors of ink, in addition to yellow (Y), magenta (M), cyan (C), and black (K), it is possible to use light cyan (LC), a light magenta (LM), and a dark yellow (DY). In addition, ink corresponding to various colors of red, violet, blue, green, and the like may also be used.

Medium

Regular paper, mat paper, cut paper, glossy paper, roll sheet, a sheet, photo paper, roll type photo paper, and the like may be used as a medium. In addition to those kinds of paper, a film material such as an OHP film and a glossy film, a cloth material, a metal plate material, and the like may also be used. That is, any kind of medium may be used as long as the medium serves as an object to be printed.

What is claimed is:

1. A printing apparatus comprising:

a print head operable to perform printing with respect to a medium;

a motor operable to move the print head;

a guide unit operable to guide the print head along a predetermined direction;

a determination unit operable to determine whether or not the print head performs a stick-slip operation; and a motor control unit operable to generate a command value for controlling the motor when moving the print head, wherein the motor control unit generates a command value for moving the print head at a predetermined target speed on the basis of determination of the determination unit that the print head does not perform the stick-slip operation; and the motor control unit generates a command value for moving the print head at a second target speed that is faster than the predetermined target speed on the basis of determination of the determination unit that the print head performs the stick-slip operation.

2. The printing apparatus according to claim 1, wherein the motor control unit sets a target stopping position of the print head and calculates a distance from the print head to the target stopping position of the print head, and wherein the motor control unit sets the second target speed on the basis of the distance from the print head to the target stopping position of the print head.

3. The printing apparatus according to claim 1, wherein the motor control unit sets a target stopping position of the print head and calculates a distance form the print head to the target stopping position of the print head, and wherein the motor control unit sets the second target speed to a fixed value when the distance from the print head to the target stopping position of the print head is larger than a predetermined distance.

4. The printing apparatus according to claim 1, wherein the motor control unit sets a target stopping position of the print head and calculates a distance form the print head to the target stopping position of the print head, and wherein the motor control unit sets the second target speed to a speed higher than a maximum speed of the print head at the time of the stick-slip operation when the distance from the print head to the target stopping position of the print head is larger than a predetermined distance.

5. The printing apparatus according to claim 1, further comprising:

a storage unit operable to store a stick-slip region set on the basis of a position determined by the determination unit, in which the print head performs the stick-slip operation, wherein the motor control unit generates a command value for moving the print head at the predetermined target speed when the print head is not positioned in the stick-slip region and generates a command value for moving the print head at the second target speed when the print head is positioned in the stick-slip region.

6. The printing apparatus according to claim 5, wherein the storage unit stores a predetermined range from the position determined by the determination unit, in which the print head performs the stick-slip operation, as the stick-slip region.

7. The printing apparatus according to claim 1, wherein the determination on whether the stick-slip operation is performed or not is made by the determination unit when the print head moves along the guide unit at a speed equal to or lower than a predetermined speed.

8. The printing apparatus according to claim 1, further comprising:

a speed detection unit operable to detect a movement speed of the print head, wherein the determination unit determines whether or not the print head performs a stick-slip operation on the basis of the movement speed detected by the speed detection unit.

9. The printing apparatus according to claim 1, wherein the determination unit determines whether or not the print head performs a stick-slip operation on the basis of the command value.

10. The printing apparatus according to claim 1, farther comprising:

an acceleration detection unit operable to detect acceleration of the print head, wherein the determination unit determines whether or not the print head performs a stick-slip operation on the basis of the acceleration detected by the acceleration detection unit.

11. The printing apparatus according to claim 1, further comprising:

a timer that measures time, for which a movement speed of the print head is equal to or lower than a predetermined allowed lower-limit value, over a period of time from starting of movement of the print head to completion of the movement of the print head, wherein the determination unit determines whether or not the print head performs a stick-slip operation on the basis of the time measured by the timer.

12. The printing apparatus according to claim 1, wherein the print head has nozzles from which ink is ejected toward the medium in order to perform printing with respect to the medium.

13. A method for coping with stick-slip comprising:

generating a command value for controlling a motor operable to move a print head in order to move the print head, which performs printing with respect to a medium, along a guide unit that guides the print head along a predetermined direction;

determining whether or not the print head performs a stick-slip operation; and generating a command value for moving the print head at a predetermined target speed on the basis of the determination that the print head does not perform the stick-slip operation; and generating a command value for moving the print head at a second target speed that is faster than the predetermined target speed on the basis of the determination that the print head performs the stick-slip operation.

14. A program product comprising a non-transitory recording medium having recorded a program operable to cause a computer to execute the method as set forth in claim 13.

* * * * *